US010442191B2

(12) United States Patent
Takahashi et al.

(10) Patent No.: US 10,442,191 B2
(45) Date of Patent: Oct. 15, 2019

(54) PRINTING APPARATUS AND PRINTING METHOD

(71) Applicant: CANON KABUSHIKI KAISHA, Tokyo (JP)

(72) Inventors: Atsushi Takahashi, Tama (JP); Takatoshi Nakano, Yokohama (JP); Takuya Fukasawa, Kawasaki (JP); Rinako Kameshima, Tachikawa (JP); Minoru Teshigawara, Saitama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/819,332

(22) Filed: Nov. 21, 2017

(65) Prior Publication Data

US 2018/0154630 A1 Jun. 7, 2018

(30) Foreign Application Priority Data

Dec. 1, 2016 (JP) ..... 2016-234271

(51) Int. Cl.
*B41J 2/045* (2006.01)
*B41J 2/165* (2006.01)

(52) U.S. Cl.
CPC ..... *B41J 2/04563* (2013.01); *B41J 2/04586* (2013.01); *B41J 2/1652* (2013.01); *B41J 2/16526* (2013.01); *B41J 2/16532* (2013.01); *B41J 2002/16573* (2013.01); *B41J 2202/12* (2013.01); *B41J 2202/20* (2013.01)

(58) Field of Classification Search
CPC ..... B41J 2/16526; B41J 2/16585; B41J 2/17596; B41J 2002/16573
See application file for complete search history.

(56) References Cited

U.S. PATENT DOCUMENTS

| | | | | |
|---|---|---|---|---|
| 6,984,009 | B2 | 1/2006 | Nakagawa et al. | |
| 6,994,416 | B2 | 2/2006 | Seki et al. | |
| 7,011,386 | B2 | 3/2006 | Iwasaki et al. | |
| 7,374,267 | B2 | 5/2008 | Oshio et al. | |
| 7,396,095 | B2 * | 7/2008 | Nakagawa | B41J 2/2125 347/9 |
| 7,399,046 | B2 | 7/2008 | Teshigawara et al. | |
| 7,448,721 | B2 | 11/2008 | Oshio et al. | |
| 7,465,006 | B2 | 12/2008 | Edamura et al. | |
| 7,673,959 | B2 | 3/2010 | Maru et al. | |
| 8,398,206 | B2 * | 3/2013 | Yamamoto | B41J 2/16538 347/33 |
| 8,752,930 | B2 | 6/2014 | Doi et al. | |

(Continued)

FOREIGN PATENT DOCUMENTS

| | | |
|---|---|---|
| CN | 103879151 A | 6/2014 |
| JP | 2000-289216 A | 10/2000 |

OTHER PUBLICATIONS

U.S. Appl. No. 15/649,789, filed Jul. 14, 2017 (First Named Inventor: Rinako Kameshima).

(Continued)

*Primary Examiner* — John Zimmermann
(74) *Attorney, Agent, or Firm* — Venable LLP

(57) ABSTRACT

Control modes for controlling recovery operation and printing operation of an ejection head in relation to each other include first and second control modes that can be selected according to a viscosity of liquid. In such control modes, different recovery operations are set.

13 Claims, 32 Drawing Sheets

(56) References Cited

U.S. PATENT DOCUMENTS

| | | | | |
|---|---|---|---|---|
| 8,820,891 | B2 | 9/2014 | Bansyo | |
| 8,851,618 | B2 | 10/2014 | Teshigawara et al. | |
| 9,096,065 | B2 | 8/2015 | Nakano et al. | |
| 9,108,410 | B2 | 8/2015 | Hamasaki et al. | |
| 9,387,679 | B2 | 7/2016 | Shiiba et al. | |
| 9,446,595 | B2 | 9/2016 | Takarabe et al. | |
| 9,517,628 | B2 | 12/2016 | Tenkawa et al. | |
| 2002/0101472 | A1 | 8/2002 | Tsuboi et al. | |
| 2007/0008368 | A1 | 1/2007 | Maru et al. | |
| 2007/0279451 | A1 | 12/2007 | Mizoguchi et al. | |
| 2008/0218554 | A1 | 9/2008 | Inoue | |
| 2010/0321425 | A1* | 12/2010 | Kanke | B41J 2/1652 347/6 |
| 2013/0100200 | A1 | 4/2013 | Hamasaki et al. | |
| 2013/0100205 | A1* | 4/2013 | Sunouchi | B41J 2/175 347/37 |
| 2013/0293603 | A1* | 11/2013 | Roof | B41J 2/175 347/6 |
| 2014/0168306 | A1 | 6/2014 | Bansyo | |
| 2016/0052278 | A1 | 2/2016 | Iwasaki et al. | |

OTHER PUBLICATIONS

U.S. Appl. No. 15/623,833, filed Jun. 15, 2017 (First Named Inventor: Takatoshi Nakano).
European Search Report issued in corresponding European Application No. 17001907.9 dated Apr. 18, 2018.
Chinese Office Action dated Aug. 9, 2019, in related Chinese Patent Application No. 201711248162.7 (with English translation).

* cited by examiner

| VAPORIZATION COEFFICIENT V | | ENVIRONMENTAL TEMPERATURE | | | | |
|---|---|---|---|---|---|---|
| | | BELOW 15°C | EQUAL TO OR HIGHER THAN 15°C AND BELOW 25°C | EQUAL TO OR HIGHER THAN 25°C AND BELOW 30°C | EQUAL TO OR HIGHER THAN 30°C AND BELOW 35°C | EQUAL TO OR HIGHER THAN 35°C |
| ENVIRON-MENTAL HUMIDITY | EQUAL TO OR HIGHER THAN 0% AND BELOW 25% | 2 | 3 | 4 | 5 | 5 |
| | EQUAL TO OR HIGHER THAN 25% AND BELOW 50% | 2 | 2 | 3 | 4 | 5 |
| | EQUAL TO OR HIGHER THAN 50% AND BELOW 75% | 1 | 2 | 3 | 4 | 4 |
| | EQUAL TO OR HIGHER THAN 75% | 1 | 1 | 2 | 3 | 3 |

FIG.17

| CONTROL MODE | TARGET REGULATED TEMPERATURE |
|---|---|
| FIRST | 35°C |
| SECOND | 45°C |

FIG.19A

| EVAPORATION AMOUNT ΣV(n) | IN FIRST CONTROL MODE | |
|---|---|---|
| | RECOVERY PROCESSING | RECOVERY AMOUNT /COLOR |
| EQUAL TO OR GREATER THAN 0 AND LESS THAN 360 | PRELIMINARY EJECTION 1000 INK DROPLETS | 0.10g |
| EQUAL TO OR GREATER THAN 360 AND LESS THAN 720 | PRELIMINARY EJECTION 2000 INK DROPLETS | 0.20g |
| EQUAL TO OR GREATER THAN 720 AND LESS THAN 1200 | SUCTION WIPING | 0.33g |
| EQUAL TO OR GREATER THAN 1200 | HIGH-POWER SUCTION WIPING | 0.66g |

FIG.19B

| EVAPORATION AMOUNT ΣV(n) | IN SECOND CONTROL MODE | |
|---|---|---|
| | RECOVERY PROCESSING | RECOVERY AMOUNT /COLOR |
| EQUAL TO OR GREATER THAN 0 AND LESS THAN 360 | NOT SET | - |
| EQUAL TO OR GREATER THAN 360 AND LESS THAN 720 | | - |
| EQUAL TO OR GREATER THAN 720 AND LESS THAN 1200 | PRELIMINARY EJECTION 2000 INK DROPLETS | 0.20g |
| EQUAL TO OR GREATER THAN 1200 | SUCTION WIPING | 0.33g |

FIG.19C

| CONTROL MODE | TARGET REGULATED TEMPERATURE | MAXIMUM EJECTION FREQUENCY |
|---|---|---|
| FIRST | 35℃ | 12kHz |
| SECOND | 45℃ | 10kHz |

PRINTING APPARATUS AND PRINTING METHOD

BACKGROUND OF THE INVENTION

Field of the Invention

The present invention relates to a printing apparatus and a printing method for ejecting liquid such as ink.

Description of the Related Art

Japanese Patent Application Laid-Open No. 2000-289216 discloses, as a printing apparatus, an ink jet printing apparatus for printing images by ejecting ink (liquid) from a print head (ejection head). This printing apparatus allows selection between a first mode and a second mode depending on the elapsed time from the last cleaning (recovery processing) performed on the print head or from power interruption. The first mode is a mode for performing printing operation after cleaning the print head. The second mode is a mode for performing the same printing operation as in the first mode without cleaning the print head. The second mode can meet the need for users to immediately print an image.

However, if the printing operation is performed without cleaning the print head, the print head may has trouble in ejecting ink, causing poor print performance for images. As a result, the users may have drawbacks.

SUMMARY OF THE INVENTION

The present invention provides a printing apparatus and a printing method that can reduce trouble with liquid ejection while meeting the need for users to allow an ejection head to immediately eject liquid.

In the first aspect of the present invention, there is provided a printing apparatus for printing by ejecting liquid from an ejection head, the printing apparatus comprising:

a print control unit configured to perform a printing operation by ejecting liquid from the ejection head;

a recovery control unit configured to perform a recovery operation to recover an ejection state in the ejection head before the printing operation is performed by the print control unit; and a setting unit configured to set (i) a first control mode where a first recovery operation is performed as the recovery operation, in a case where the printing operation is performed under a first printing condition, and (ii) a second control mode where a second recovery operation for recovery at a lower level compared to the first recovery operation is performed as the recovery operation or the recovery operation is not performed, in a case where the printing operation is performed under a second printing condition with at least a lower viscosity of liquid compared to the first printing condition.

In the second aspect of the present invention, there is provided a printing method for printing by ejecting liquid from an ejection head, the printing method comprising:

a printing step of performing a printing operation by ejecting liquid from the ejection head;

a recovery step of performing a recovery operation to recover an ejection state in the ejection head before the printing operation; and a setting step of setting (i) a first control mode where a first recovery operation is performed as the recovery operation, in a case where the printing operation is performed under a first printing condition, and (ii) a second control mode where a second recovery operation for recovery at a lower level compared to the first recovery operation is performed as the recovery operation or the recovery operation is not performed, in a case where the printing operation is performed under a second printing condition with at least a lower viscosity of liquid compared to the first printing condition.

According to the present invention, control modes for controlling recovery operation and printing operation of an ejection head in relation to each other include first and second control modes corresponding to a viscosity of liquid. In such control modes, different conditions for liquid printing operation as well as different conditions for recovery processing are set so as to reduce trouble with liquid ejection while meeting the need for users to allow ejection heads to immediately eject liquid.

Further features of the present invention will become apparent from the following description of exemplary embodiments with reference to the attached drawings.

BRIEF DESCRIPTION OF THE DRAWINGS

FIG. 17 is a table illustrating a vaporization coefficient table;

FIG. 19A is a table illustrating the relation between first and second control modes and a target regulated temperature (ejection condition);

FIG. 19B is a table illustrating the relation between an evaporation amount in the first control mode, a condition for recovery processing, and a recovery amount;

FIG. 19C is a table illustrating the relation between an evaporation amount in the second control mode, a condition for recovery processing, and a recovery amount;

DESCRIPTION OF THE EMBODIMENTS

With reference to the drawings, embodiments of the present invention will be described. The following embodiments are application examples of an ink jet printing apparatus for printing an image by ejecting ink, as liquid, from an ink jet print head, as an ejection head. First, a description will be given of a basic configuration of an ink jet printing apparatus (liquid ejection apparatus) to which the present invention can be applied.

(Basic Configuration)

Figure 1:
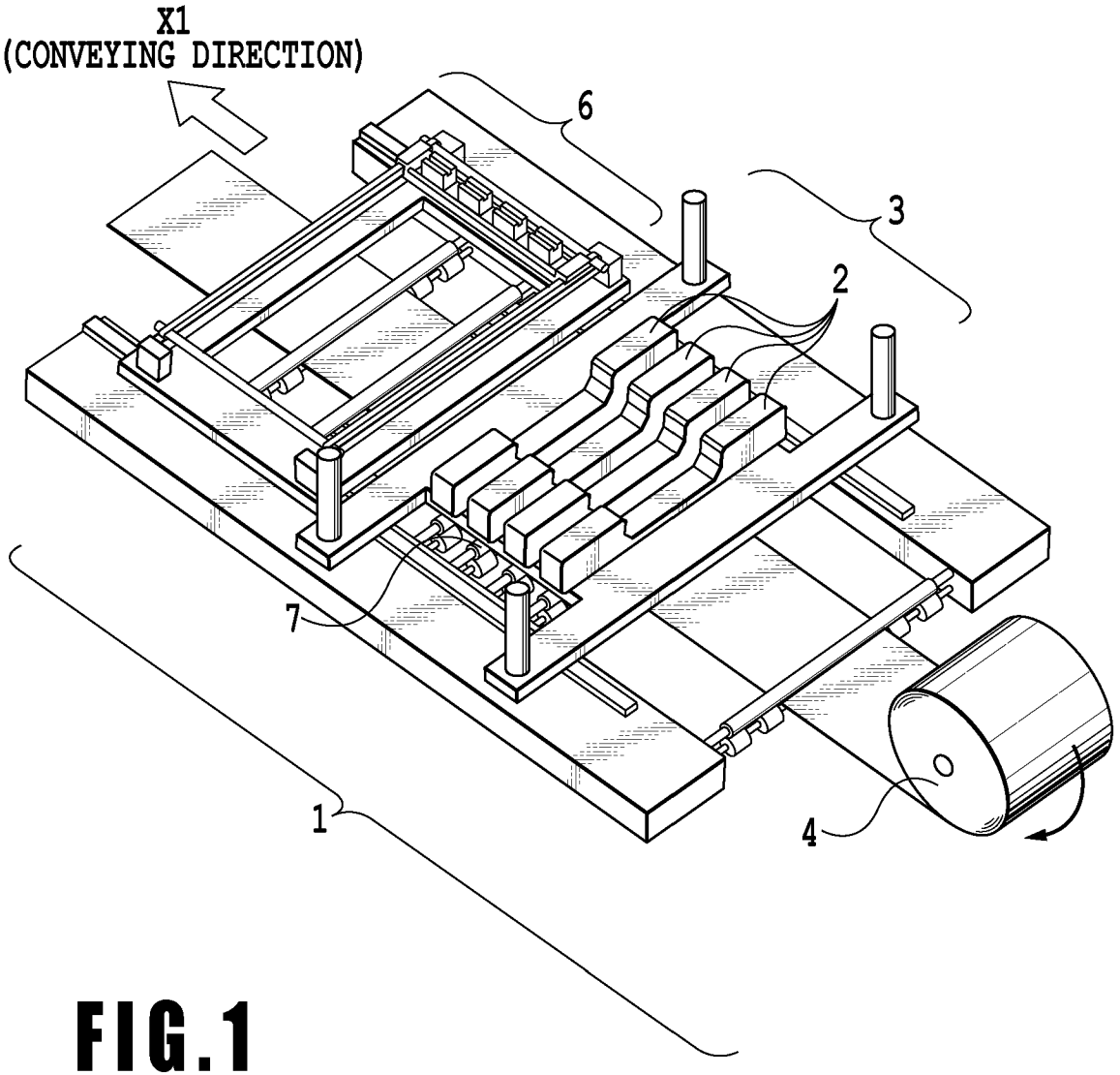
FIG. 1 is a perspective view illustrating a basic configuration of a printing apparatus to which the present invention can be applied.
Figure 2:
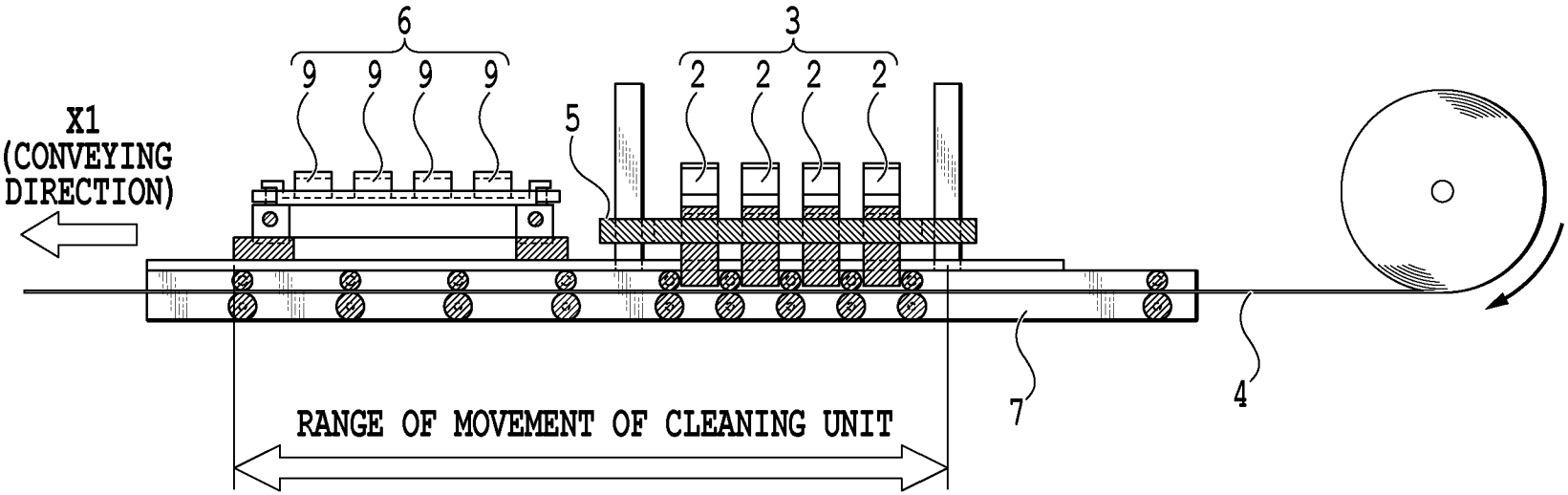
FIG. 2 is a cross-sectional view of a major part of the printing apparatus.
Figure 3:
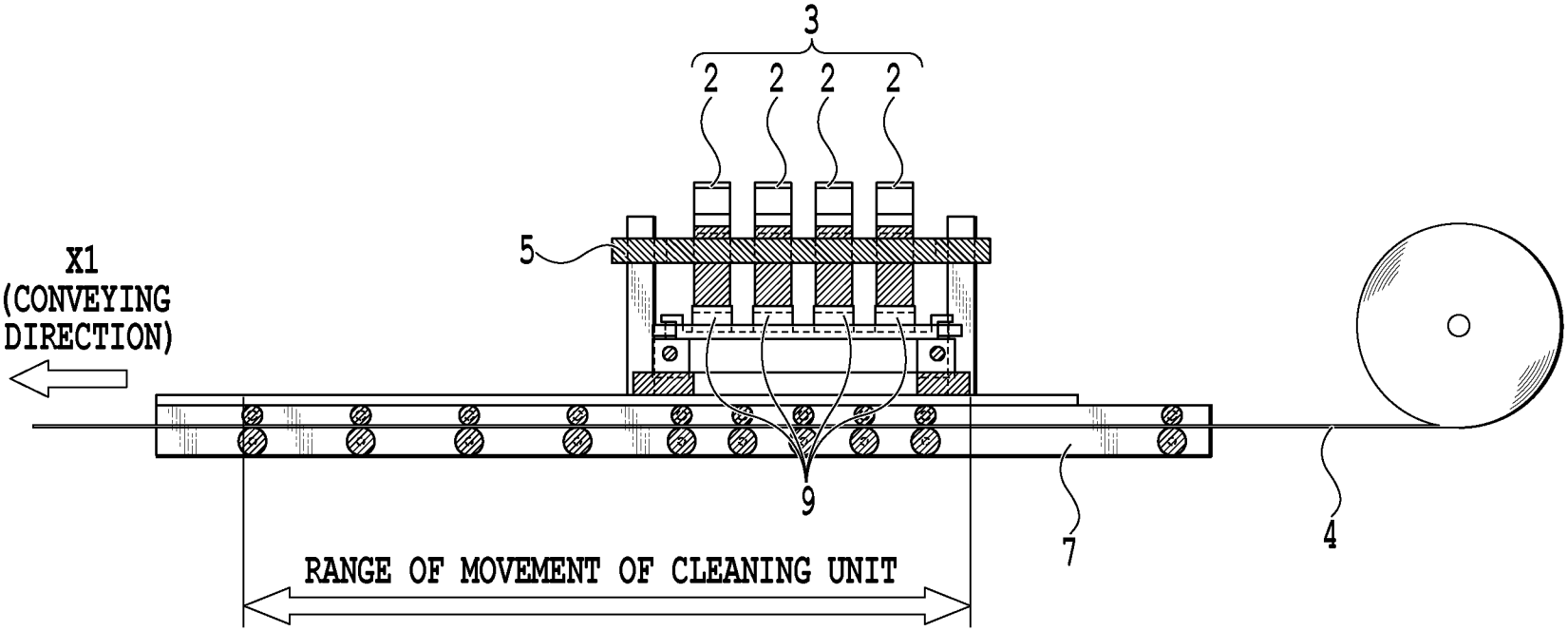
FIG. 3 is a cross-sectional view of a major part of the printing apparatus during cleaning operation.

FIG. 1 is a perspective view of a printing unit and its periphery in a printing apparatus to which the present invention can be applied. FIG. 2 is a cross-sectional view of the printing unit and its periphery shown in FIG. 1. FIG. 3 is a cross-sectional view of the printing unit of FIG. 1 during cleaning operation.

A printing apparatus 1 of the present example is a line printer for printing an image on a print medium by ejecting ink (liquid) from a print head (ejection head) having a long length while continuously conveying the print medium in a conveying direction shown by arrow X1 (first direction). The printing apparatus 1 has a holder for holding a print medium 4 such as a continuous sheet wound up in a roll, a conveying mechanism 7 for conveying the print medium 4 at a predetermined speed in the first direction, and a printing unit 3 for printing an image on the print medium 4 by a print head 2. It should be noted that the print medium is not limited to a continuous rolled print medium but may be a cut print medium. The printing apparatus 1 also has a cleaning unit (recovery processing unit) 6 for removing a material adhered to a nozzle surface (a surface on which ejection ports are formed) of the print head 2. Furthermore, downstream of the printing unit 3 in a conveying path of the print medium 4, there are provided a cutter unit for cutting the print medium 4, a drying unit for forcibly drying the print medium, and a discharge tray along the conveying path.

The printing unit 3 has a plurality of print heads 2 each corresponding to a different one of ink colors. In the present example, the printing unit 3 has four print heads corresponding to four colors of ink: cyan (C), magenta (M), yellow (Y), and black (K). However, the number of ink colors and the number of print heads provided are not limited to four. Ink of each color is supplied to the corresponding print head 2 independently via an ink tube from an ink tank (not shown). The plurality of print heads 2 are integrally held by a head holder 5, and there is provided a mechanism for allowing the head holder 5 to move vertically so as to change a distance between the plurality of print heads 2 and the surface of the print medium 4. There is also provided a mechanism for allowing the head holder 5 to move parallel in a direction shown by arrow X2 (second direction) which crosses the first direction.

The cleaning unit 6 has a plurality of (four) cleaning mechanisms 9 corresponding to the plurality of (four) print heads 2. Details of each cleaning mechanism 9 will be described later. The cleaning unit 6 is configured to slide and move in the first direction (X1 direction) by a drive motor (not shown). FIG. 1 and FIG. 2 show the states during printing, where the cleaning unit 6 is located downstream of the printing unit 3 in the conveying direction (arrow X1 direction) of the print medium 4. Meanwhile, FIG. 3 shows a state during cleaning operation (during recovery processing), where the cleaning unit 6 is located immediately below the print head 2 in the printing unit 3. FIG. 2 and FIG. 3 show a movable range of the cleaning unit 6.

Figure 4A:
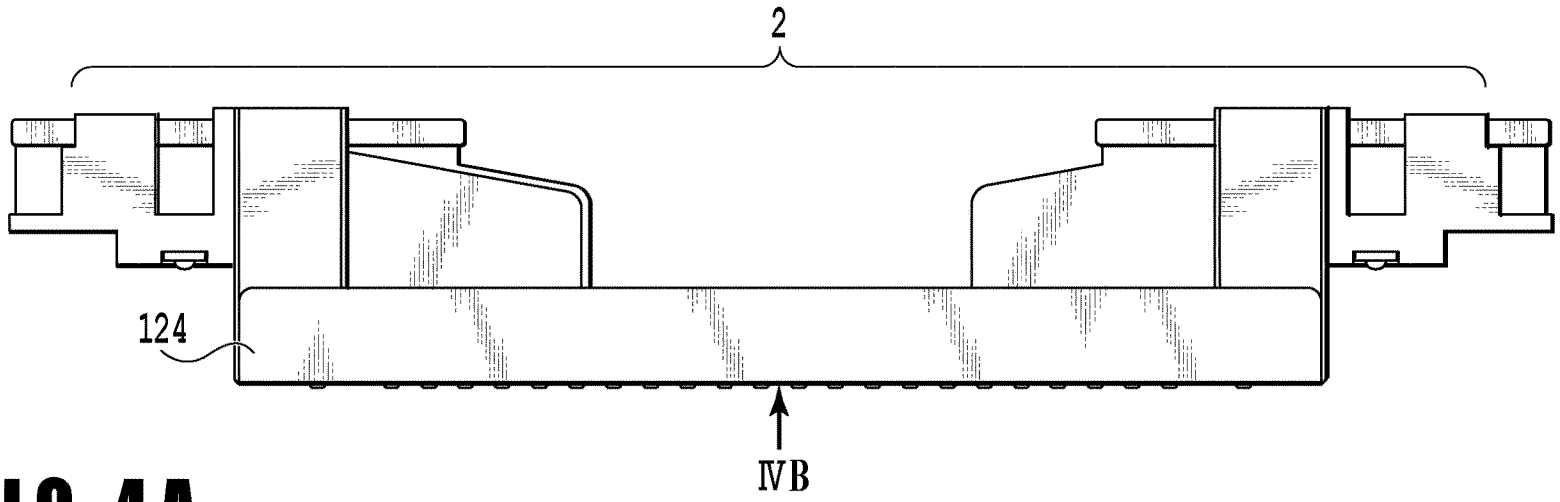
FIGS. 4A and 4B are views illustrating the print head shown in FIG. 1.
Figure 4B:
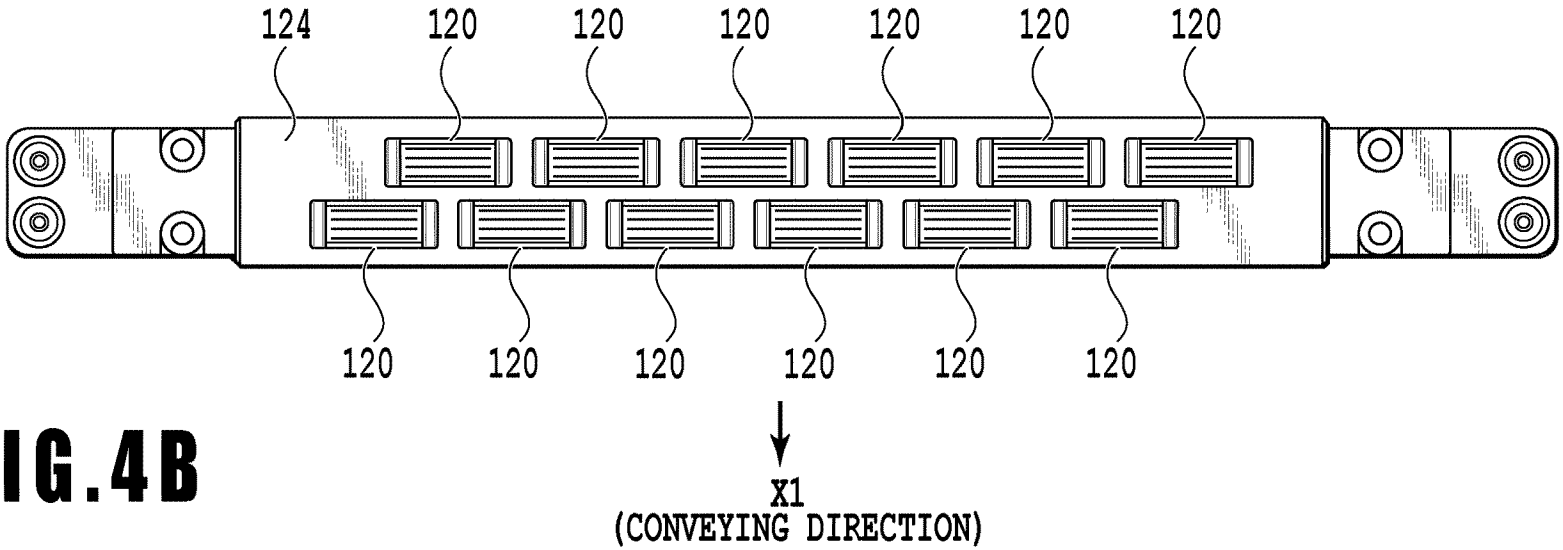

FIGS. 4A and 4B are views illustrating the structure of one of the print heads 2. The print head 2 is an ink jet type print head that ejects ink. Examples of the ink jet type include a type using a heat generating element, a type using a piezoelectric element, a type using an electrostatic element, a type using an MEMS element, and the like. The print head 2 is a line type print head on which ink jet type nozzle arrays are formed across the range covering the maximum width of a print medium that is expected for use. A direction in which the nozzle arrays are arranged is the second direction which crosses the first direction, such as a direction shown by arrow X2 (lateral direction in FIG. 4A) which is perpendicular to the first direction. On a large base substrate 124, a plurality of nozzle chips 120 are arranged along the second direction (X2 direction). In the example of FIG. 4B, the plurality of (12 in the present example) nozzle chips 120 each having the same size and the same structure are regularly arranged across the entire area in the width direction of the print medium to form two rows of the nozzle chips in a staggered arrangement. That is, in the print head 2, a plurality of first nozzle chips each having nozzle arrays and a plurality of second nozzle chips each having nozzle arrays are arranged to form separate rows along the second direction. Furthermore, the first nozzle chips and the second nozzle chips that are adjacent to each other in the first direction (X1 direction) are staggered in the second direction. Part of the nozzle arrays included in the first nozzle chip and part of the nozzle arrays included in the second nozzle chip adjacent to the first nozzle chip overlap each other in the second direction.

Figure 5:
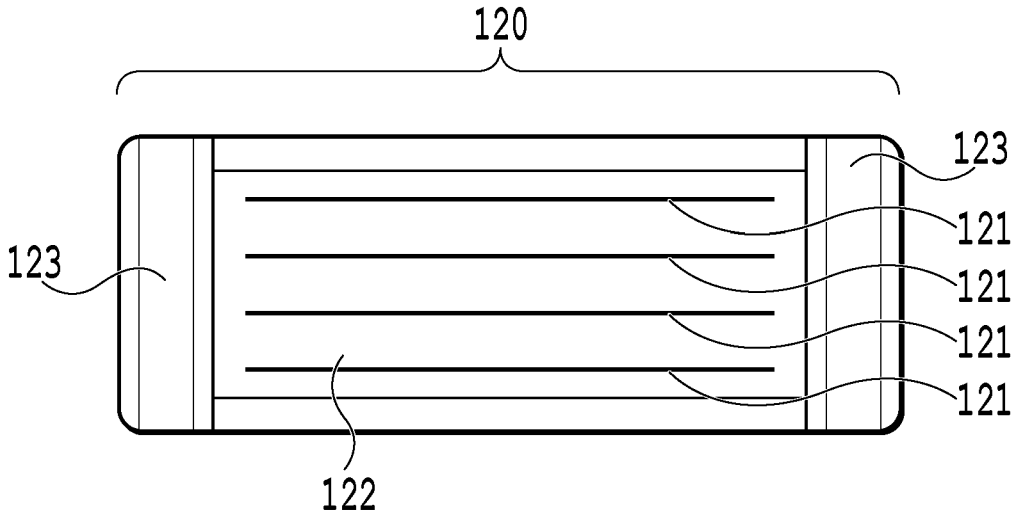
FIG. 5 is a view illustrating the nozzle chip shown in FIG. 4B.

FIG. 5 is a view illustrating the structure of one of the nozzle chips 120 forming the print head 2. On the nozzle chip 120, nozzle arrays 121 in which a plurality of nozzles capable of ejecting ink are arranged is formed. On a nozzle surface 122 of the nozzle chip 120, ejection ports of the nozzles of the nozzle chip 120 are formed. Furthermore, in a nozzle substrate of the nozzle chip 120, ejection energy generation elements corresponding to the nozzles are embedded. The ejection energy generation elements are elements for generating energy for ink ejection, and heat generating elements, piezoelectric elements, or the like may be used. The nozzle chip 120 has a plurality of (four in the present example) nozzle arrays 121, that is, four rows of the nozzle arrays 121 are arranged in parallel in the first direction (X1 direction). The nozzle substrate of the nozzle chip 120 is provided on the base substrate 124 shown in FIG. 4B. The nozzle substrate and the base substrate 124 are connected by electrical connection parts, which are covered by sealing parts 123 made of resign material so as to be protected from corrosion and a break.

Figure 7:
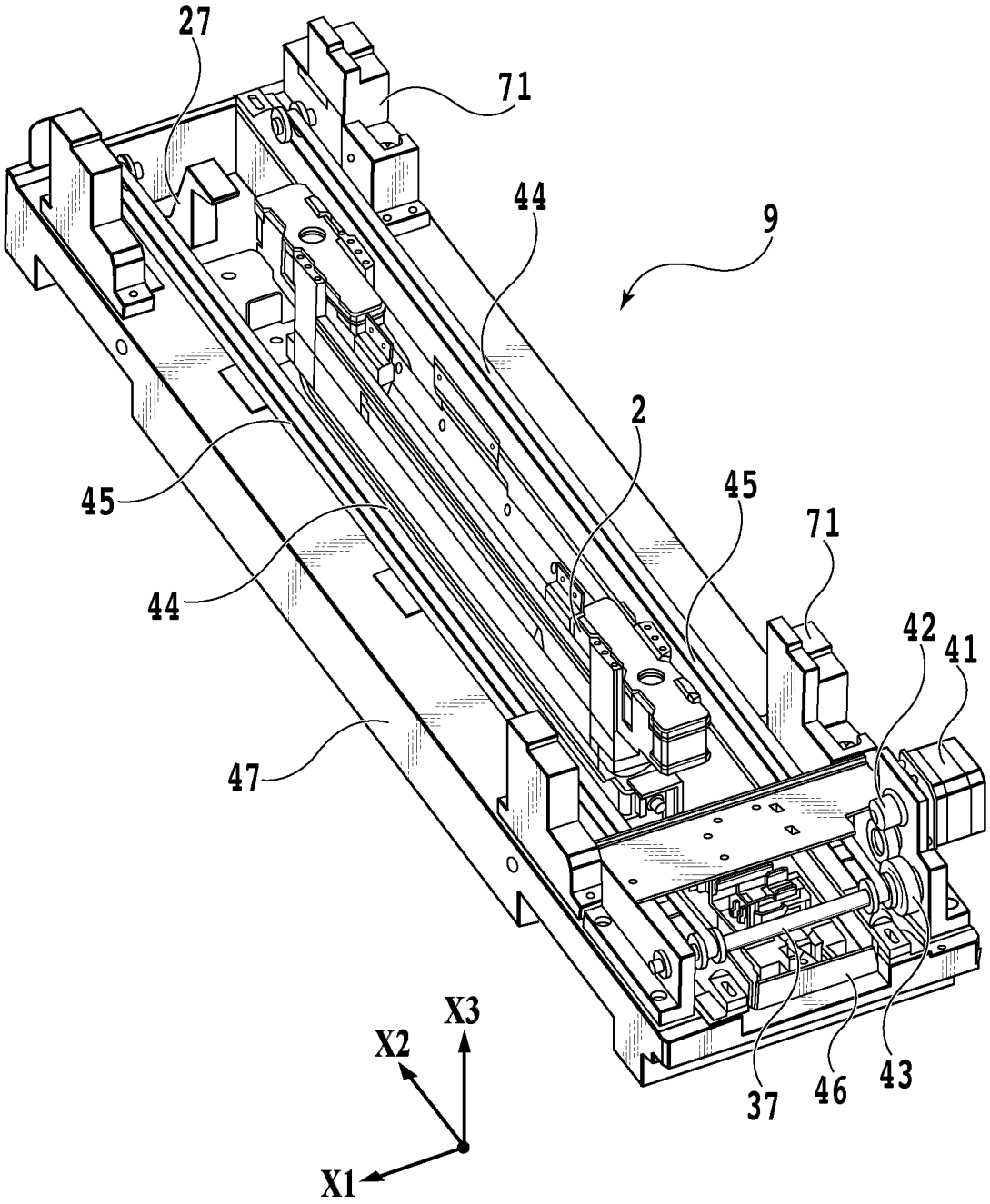
FIG. 7 is a perspective view of the cleaning mechanism shown in FIG. 2 during cleaning operation.
Figure 8:
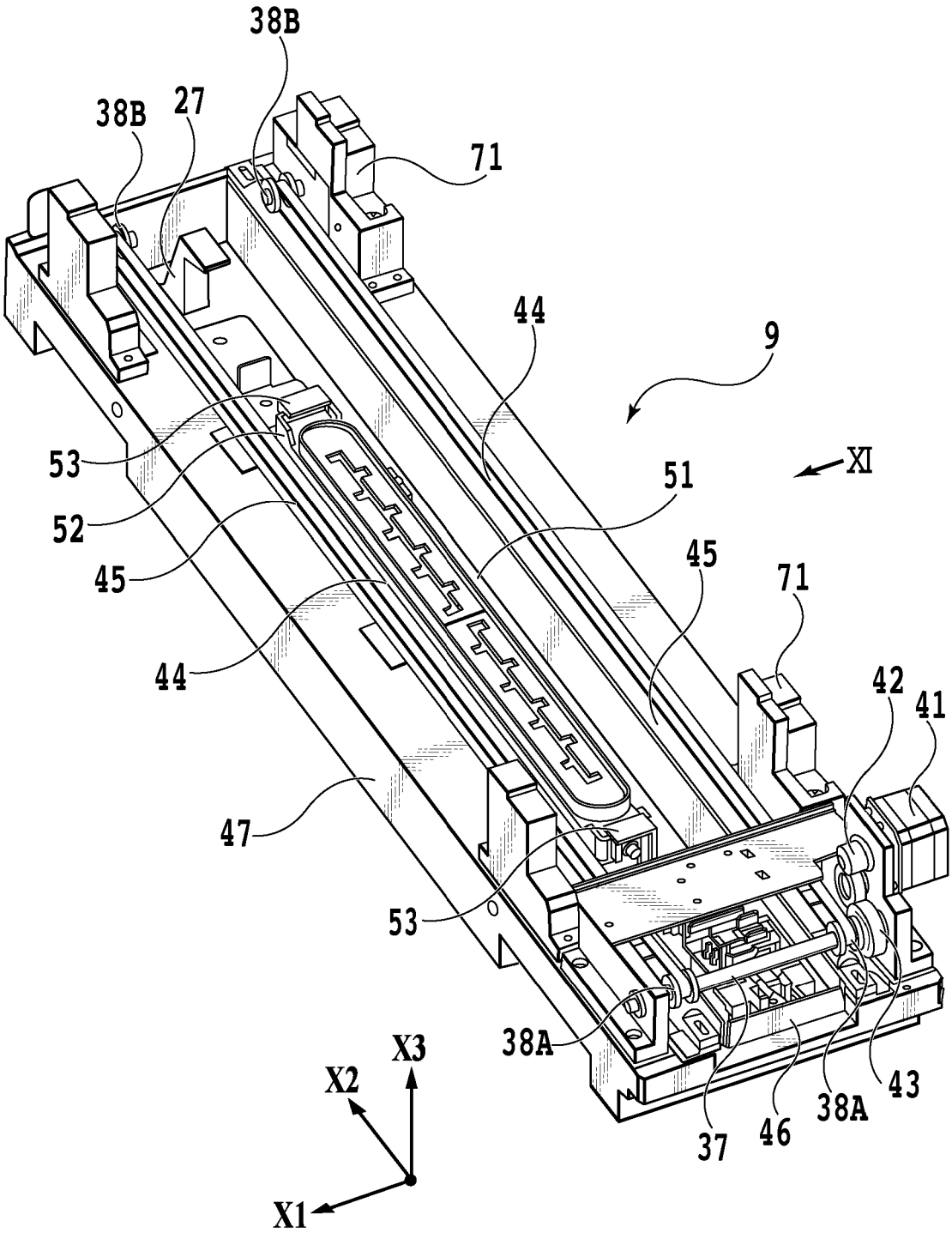
FIG. 8 is a perspective view of the cleaning mechanism.

FIG. 7 and FIG. 8 are perspective views for explaining the configuration of one of the cleaning mechanisms 9 in the cleaning unit 6. The cleaning unit 6 has the plurality of (four in the present example) cleaning mechanisms 9 corresponding to the plurality of print heads 2. FIG. 7 shows a state (during cleaning operation) in which, on one of the cleaning mechanisms 9, the corresponding print head 2 is located. FIG. 8 shows a state in which the print head 2 is not located on the corresponding one of the cleaning mechanisms 9. The cleaning unit 6 has the cleaning mechanism 9, caps 51, and positioning members 71.

The cleaning mechanism 9 has a suction wiper unit 46, a transfer mechanism for transferring the suction wiper unit 46, and a frame 47 which integrally supports the suction wiper unit 46 and the transfer mechanism. The suction wiper unit 46 is a unit for removing a material adhered to the nozzle surface 122 of the print head 2. The transfer mechanism transfers the suction wiper unit 46 along the second direction (wiping direction) shown by arrow X2. The suction wiper unit 46 is supported by two shafts 45 and the transfer mechanism transfers the suction wiper unit 46 in the second direction along the two shafts 45 by a driving force from a driving source. The driving source is a drive motor 41, and its driving force causes a drive shaft 37 to rotate by reduction gears 42, 43. Rotation of the drive shaft 37 is transmitted to the suction wiper unit 46 via two belts 44. Each of the belts 44 is placed over a drive pulley 38A and a driven pulley 38B attached to the drive shaft 37 and is also coupled to the suction wiper unit 46.

The suction wiper unit 46, as will be described later, removes a material adhered to the nozzle surface 122 of the print head 2 by suction ports (suction recovery processing). In FIG. 8, the cap 51 is held by a cap holder 52, and the cap holder 52 is urged in a third direction shown by arrow X3, which is perpendicular to the nozzle surface 122 of the print head 2, by a spring that is an elastic body. The cap holder 52 is movable against the spring. In a state in which the frame 47 has been moved to a cap position below the print head 2 as shown in FIG. 3, the print head 2 moves in a direction (vertical direction in FIG. 3) which is perpendicular to the nozzle surface 122, so that the nozzle surface 122 comes into close contact with or comes apart from the cap 51. Capping by the cap 51 coming into close contact with the nozzle surface 122 can prevent the nozzles from being dry.

The positioning member 71 comes into contact with a head positioning member 81 (described later) provided on the head holder 5 during cleaning operation and capping. As will be described later, the positional relation between the print head 2 and the cleaning unit 6 is determined by the positioning member 71 coming into contact with the head positioning member 81 in the first, second, and third directions (arrow X1, X2, and X3 directions).

Figure 9:
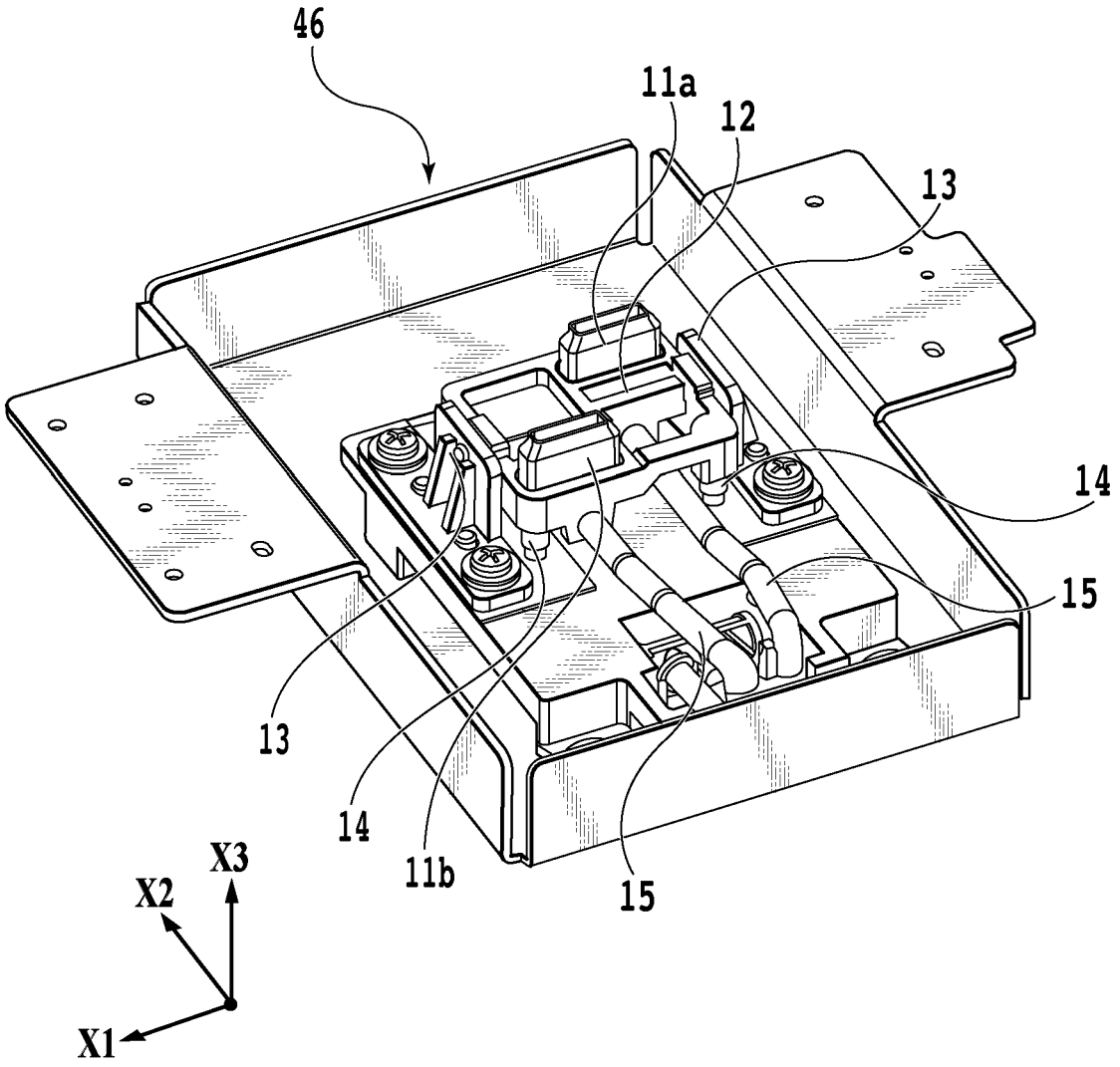
FIG. 9 is a perspective view of the suction wiper unit shown in FIG. 7.

FIG. 9 is a perspective view for explaining the configuration of the suction wiper unit 46. The suction wiper unit 46 has two suction ports, that is, a first suction port 11*a* and a second suction port 11*b* (first and second suction units) corresponding to a row of first nozzle chips and a row of second nozzle chips (first and second nozzle chip arrays), respectively. A distance between the suction ports 11*a*, 11*b* in the first direction (X1 direction) is equal to a distance between the first and second nozzle chip arrays in the first direction. A displacement amount of the suction ports 11*a*, 11*b* in the second direction (X2 direction) is equal to a displacement amount in the second direction of the first and second nozzle chip arrays being adjacent to each other in the second direction, or they are substantially the same. The suction ports 11*a*, 11*b* are held by the suction holder 12, and the suction holder 12 is urged in the third direction (X3 direction) by a spring 14 that is an elastic body. The suction holder 12 can be displaced in a direction (−X3 direction) opposite to the third direction against the spring 14. More specifically, the suction holder 12 can be displaced straight-ahead in an upward direction (third direction) in FIG. 3 in which the nozzle surface 122 faces the print medium 4, and is supported by a displacement mechanism having an elastic body. The displacement mechanism is, as will be described later, for absorbing the movement of the suction ports 11*a*, 11*b* when the suction ports 11*a*, 11*b* during movement go over sealing parts 123*a*, 123*b*. Details will be described later. Tube 15*s* are connected to the suction ports 11*a*, 11*b* by the suction holder 12, and a negative pressure generating unit such as a suction pump is connected to the tubes 15. Operating the negative pressure generating unit gives a negative pressure for sucking ink and waste inside the suction ports 11*a*, 11*b*.

Figure 6:
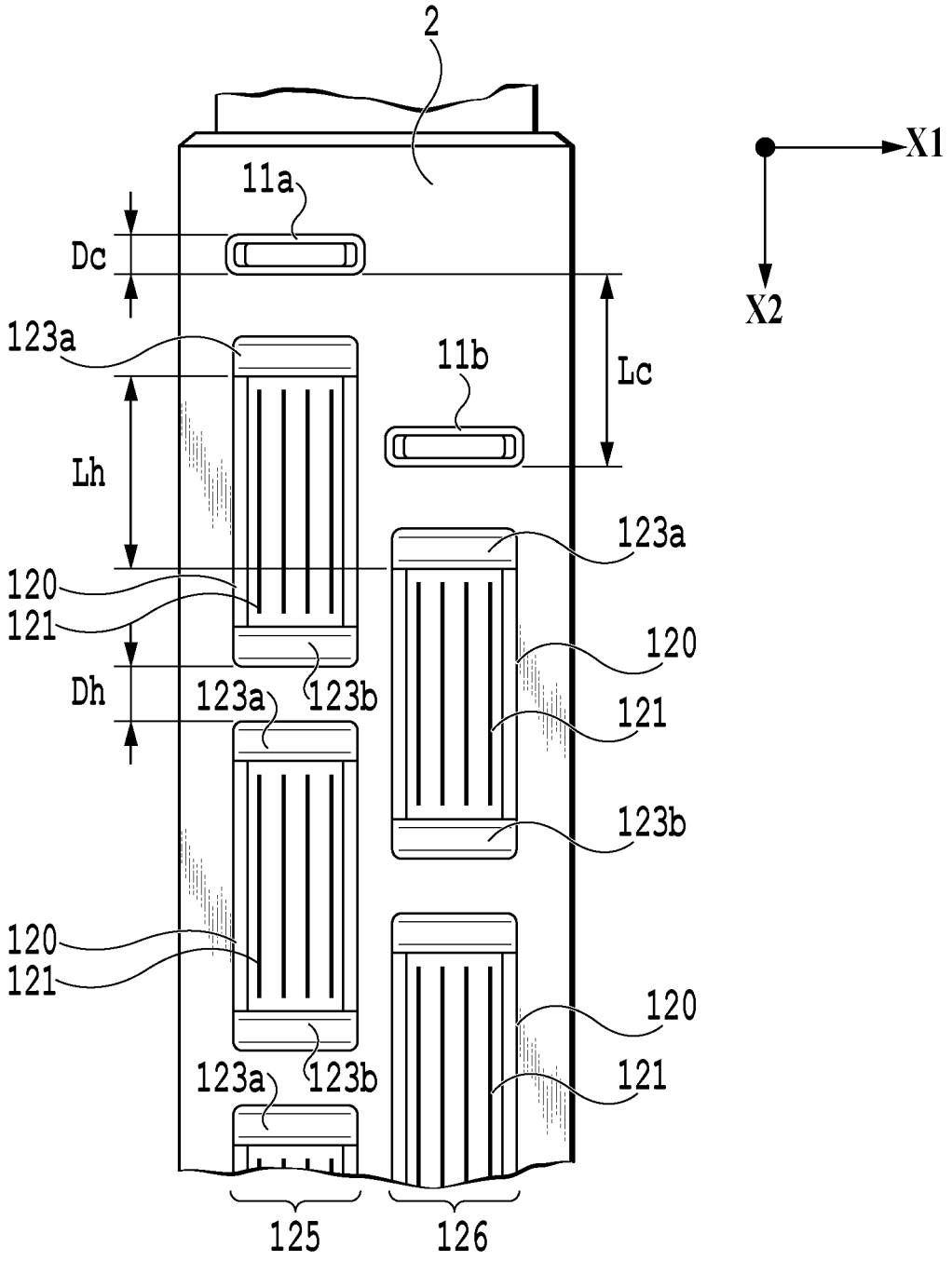
FIG. 6 is a view illustrating the positional relation between nozzle chips and suction ports.

FIG. 6 is an enlarged view for explaining the positional relation between the plurality of nozzle chips 120 of one of the print heads 2 and the first and second suction ports 11*a*, 11*b*. The plurality of nozzle chips 120 are arranged in two rows such that the nozzle chips 120 in a first nozzle chip array 125 and the nozzle chips 120 in a second nozzle chip array 126 are staggered relative to one another. The sealing part 123 is located on each side of the nozzle chip 120. One is a sealing part 123*a* and the other is a sealing part 123*b*. The nozzle chips 120 in the first nozzle chip array 125 are also referred to as first nozzle chips, and the nozzle chips 120 in the second nozzle chip array 126 are also referred to as second nozzle chips. The first and second nozzle chips 120 being adjacent to each other are separated in the second direction (X2 direction) by a predetermined distance Lh. The first suction port 11*a* corresponds to the first nozzle chip array 125 and the second suction port 11*b* corresponds to the second nozzle chip array 126. The first suction port 11*a* and the second suction port 11*b* are separated by a distance that is equal to a distance between the first nozzle chip array 125 and the second nozzle chip array 126 (a distance between both centers) in the first direction. The first suction port 11*a* is located to cover the range of the first nozzle chip array 125 in the first direction and the second suction port 11*b* is located to cover the range of the second nozzle chip array 126 in the first direction. The first suction port 11*a* and the second suction port 11*b* are separated by a distance Lc in the second direction (X2 direction).

In the second direction, the distance Lh corresponding to the displacement between the first nozzle chip 120 and the second nozzle chip 120 is equal to the distance Lc corresponding to the displacement between the suction ports 11*a*, 11*b*. As used herein, the term "equal" is not limited to the meaning of precise agreement, but has a meaning including being substantially equal, which is the same meaning as the expression "equal" as used in the present invention. As used herein, the term "substantially equal" indicates an extent that there may be a moment at which contact between the sealing part 123*a* of the first nozzle chip 120 and the first suction port 11*a* and contact between the sealing part 123*b* of the second nozzle chip 120 and the second suction port 11*b* happen at the same time. In other words, the distance Lh of the displacement is equal to the distance Lc of the displacement to an extent that the two suction ports 11*a*, 11*b* may touch their respective sealing parts of the nozzle chips 120 at the same time. As such, the positional relation between the suction ports 11*a*, 11*b* (first and second suction units) is the displacement in the second direction in a manner corresponding to the displacement of the first and second nozzle chips being adjacent to each other in the second direction.

The suction ports 11*a*, 11*b* both have a width Dc in the second direction. The width Dc corresponds to a size covering part of the nozzle arrays 121 in the second direction, and is a width corresponding to a few to a few tens of nozzles. In each of the first and second nozzle chip arrays 125, 126, a distance between the adjacent nozzle chips 120 (a distance between the sealing part 123*a* of one nozzle chip and the sealing part 123*b* of the other nozzle chip) is set to a predetermined distance Dh.

Figure 10:
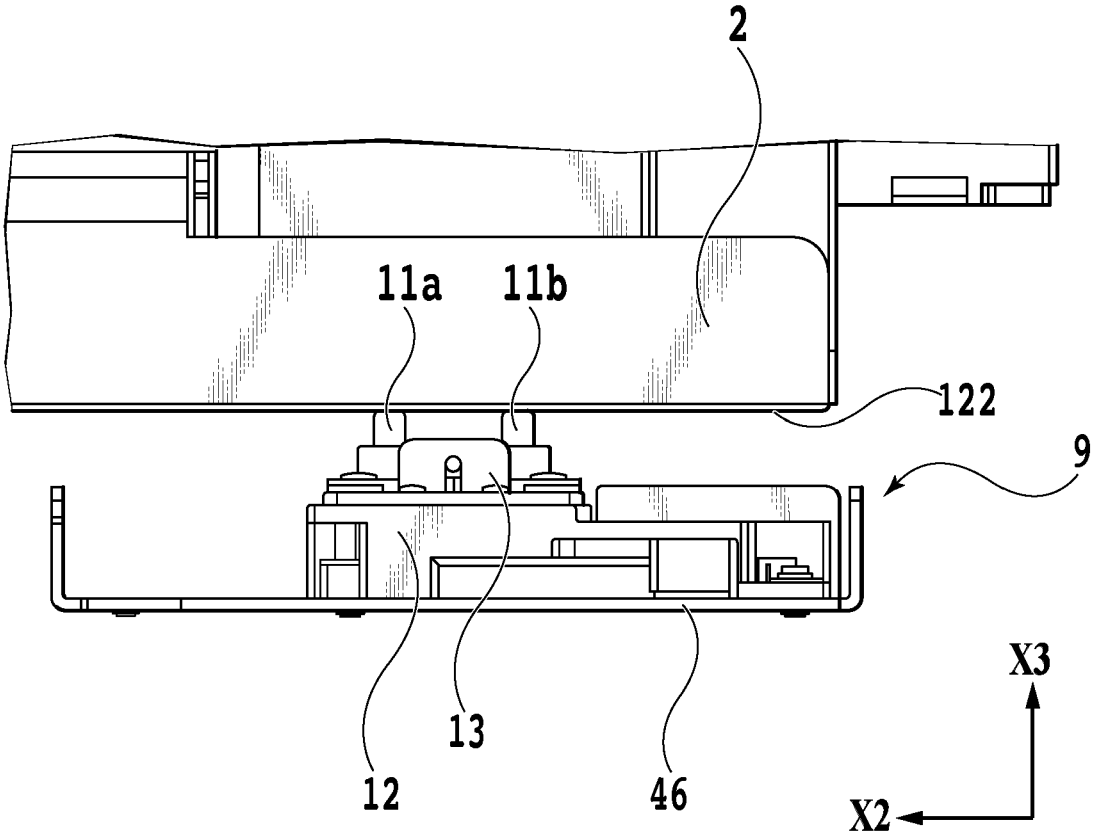
FIG. 10 is a view illustrating the operation of the cleaning mechanism.

FIG. 10 is a side view for illustrating the operation of the cleaning mechanism 9, and shows a state in which cleaning (recovery processing) is performed on the nozzle surface 122 of the print head 2 by the suction ports 11*a*, 11*b*.

The print head 2 moves downward in FIG. 10 so that end portions of the suction ports 11*a*, 11*b* come into contact with the nozzle surface 122 of the print head 2, and the position of the print head 2 in the third direction (X3 direction) is set. The suction wiper unit 46 is transferred in the second direction (X2 direction) while the negative pressure generating unit produces a negative pressure in the suction ports 11*a*, 11*b*, whereby ink, wastes, and the like adhered to the nozzle surface 122 are sucked and removed through the suction ports 11*a*, 11*b*. Such operation of the suction wiper unit 46 is also referred to as suction wiping (suction recovery processing and wiping processing). While the suction wiper unit 46 moves in the second direction, the suction ports 11*a*, 11*b* are pressed downward (−X3 direction) in FIG. 10 by the sealing parts 123*a*, 123*b* which protrude downward in FIG. 10 from the nozzle surface 122. As described above, the suction holder 12 which holds the suction ports 11*a*, 11*b* is urged in the third direction (X3 direction) by the displacement mechanism having the spring 14, and can be displaced in the direction (−X3 direction) away from the nozzle surface 122 against the spring 14. Therefore, when the suction ports 11*a*, 11*b* are pressed downward (−X3 direction) in FIG. 10 by the sealing parts 123*a*, 123*b*, the suction holder 12 is displaced downward (−X3 direction) in FIG. 10 so as to absorb the movement of the suction ports 11*a*, 11*b*.

Figure 11:
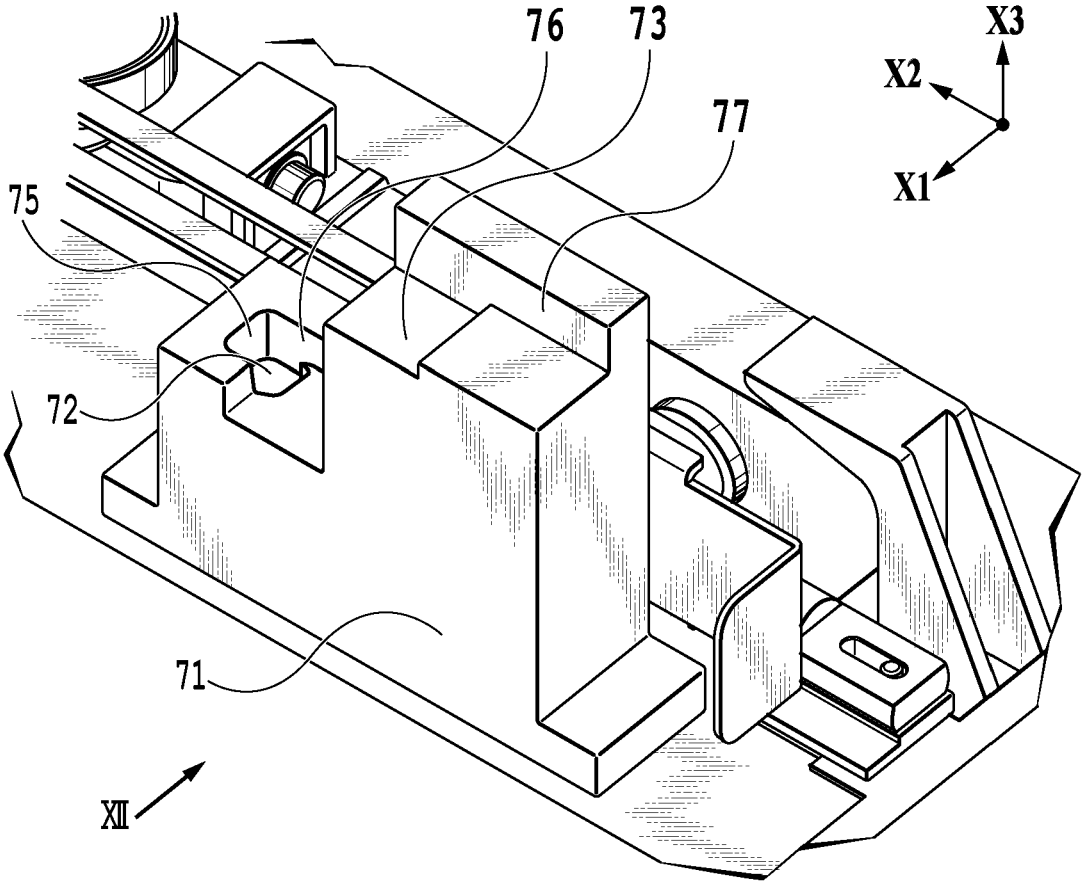
FIG. 11 is a perspective view of a positioning member in the cleaning mechanism.
Figure 12:
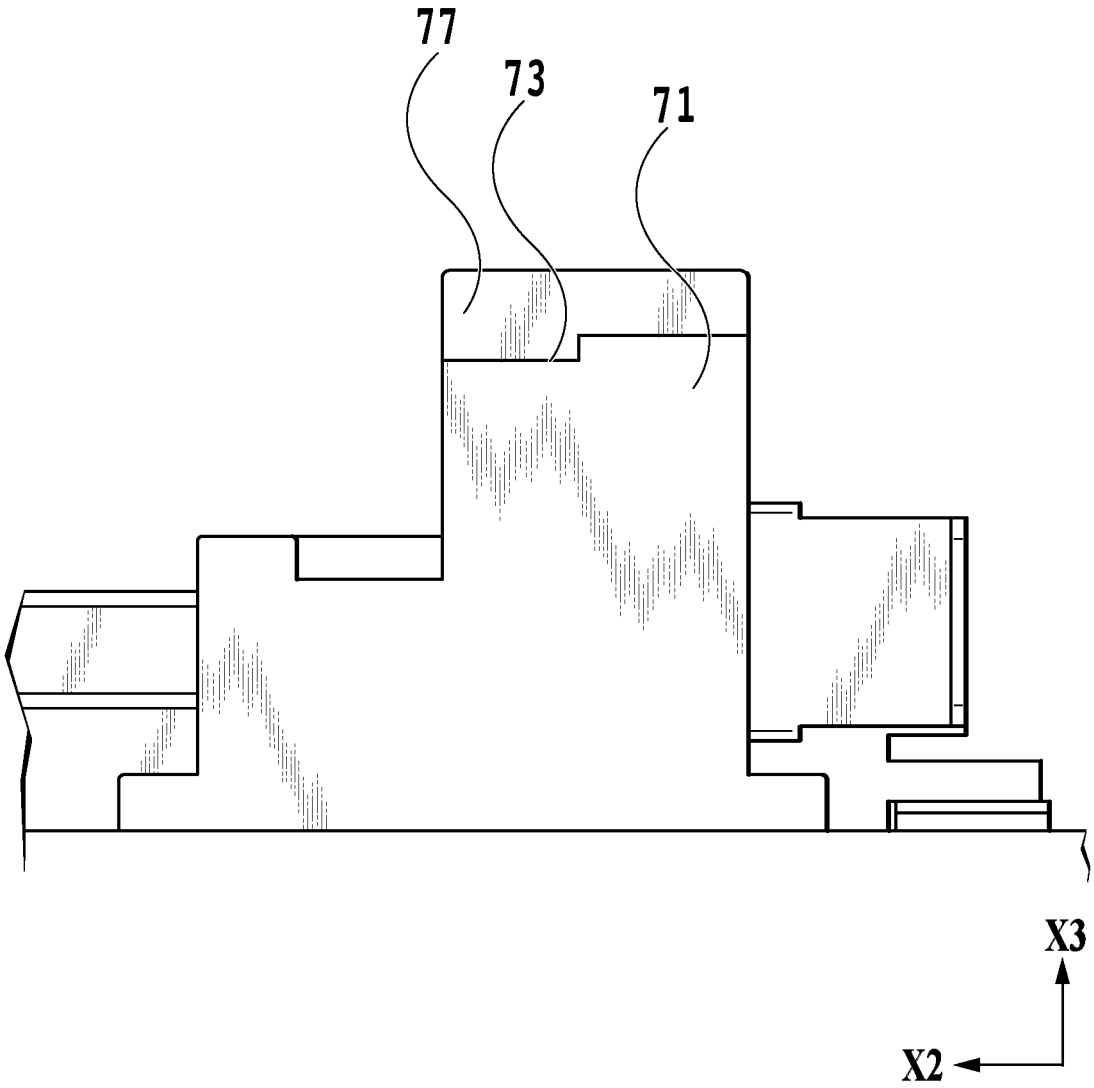
FIG. 12 is a view taken from arrow XII of FIG. 11.

FIG. 11 is an enlarged perspective view of the positioning member 71 provided on the cleaning unit 6. FIG. 12 is a side view of the positioning member 71. The positioning member 71 is provided with a first third-direction contact surface 73 and a second third-direction contact surface 72 located at different levels in the third direction (X3 direction). Further, the positioning member 71 is provided with first-direction contact surfaces 76, 77 which selectively come into contact with the head positioning member 81 (described later) of the head holder 5 in the first direction (X1 direction). The positioning member 71 is also provided with a second-direction contact surface 75 which comes into contact with the head positioning member 81 in the second direction (arrow X2).

Figure 13A:
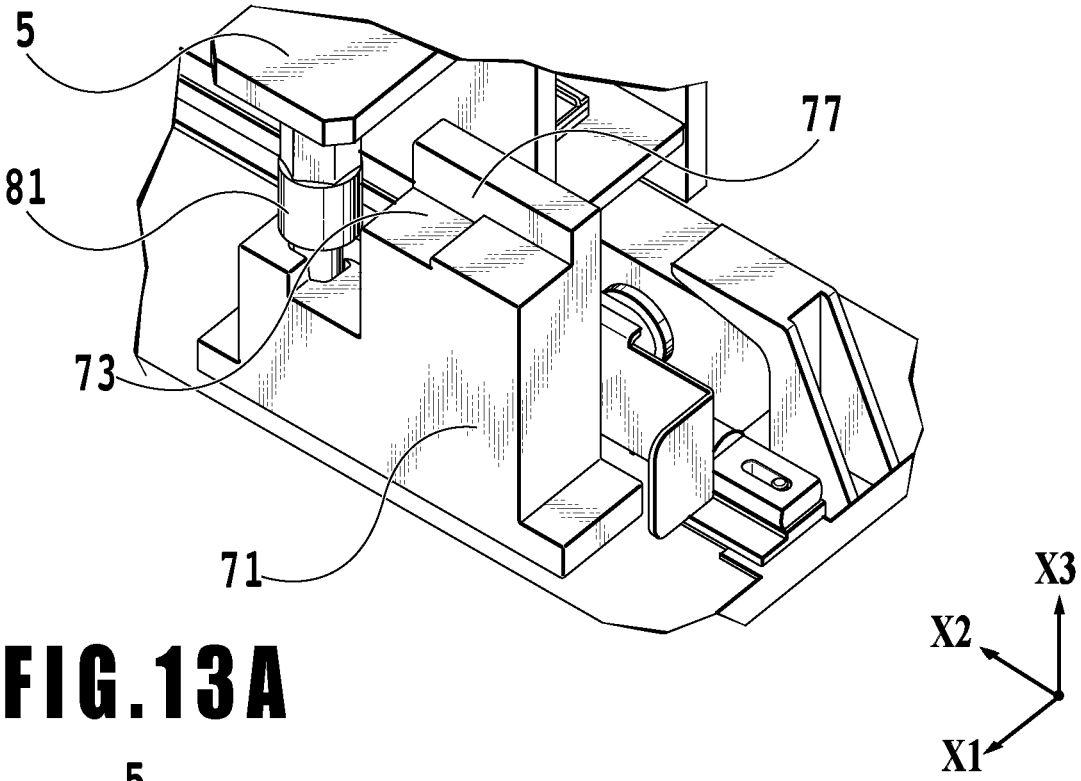
FIGS. 13A and 13B are views illustrating the relation between the positioning member and a head positioning member.
Figure 13B:
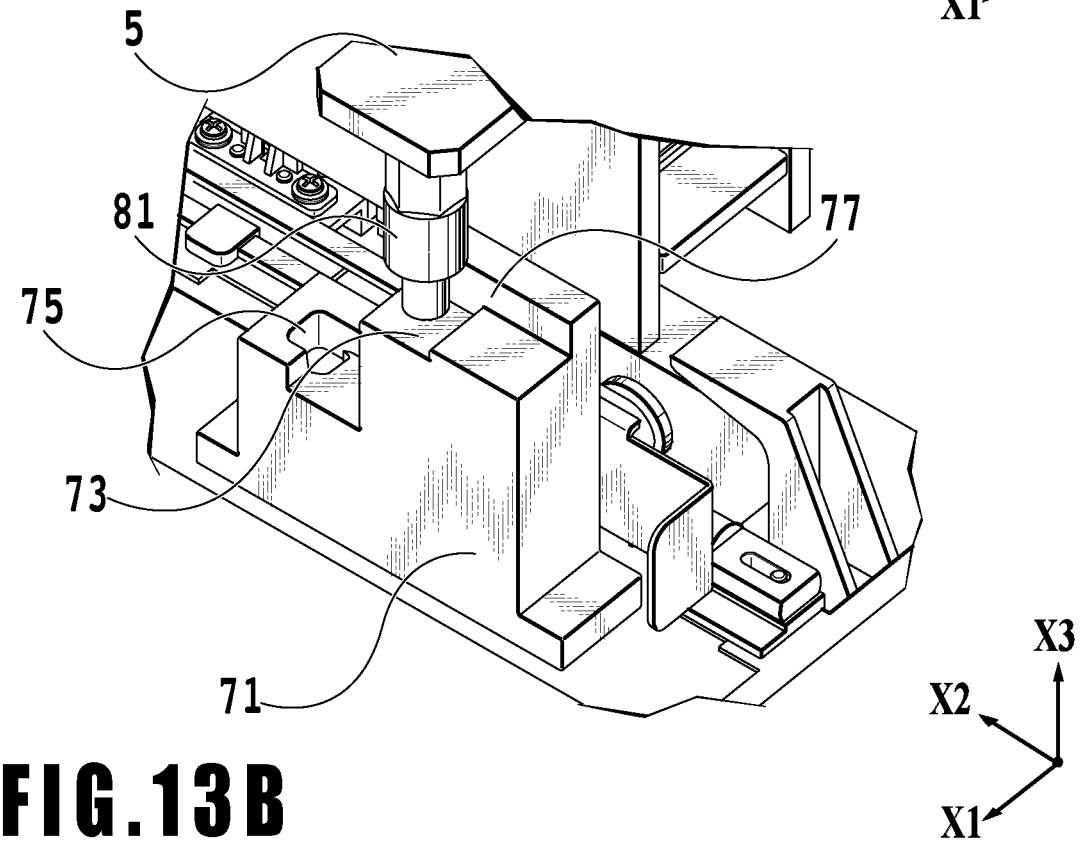

FIG. 13A is a view illustrating the positional relation between the positioning member 71 and the head positioning member 81 during capping in which the cap 51 comes into close contact with the nozzle surface 122. FIG. 13B is a view illustrating the positional relation between the positioning member 71 and the head positioning member 81 during cleaning operation by the suction ports 11*a*, 11*b*.

During capping as shown in FIG. 13A, the head positioning member 81 provided on the head holder 5 comes into contact with the first-direction contact surface 76 of the positioning member 71 in the first direction, and the head positioning member 81 comes into contact with the second-direction contact surface 75 in the second direction. The head positioning member 81 comes into contact with the second third-direction contact surface 72 in the third direction. Accordingly, the positional relation between the print head 2 and the cleaning unit 6 during capping is determined. During the capping, capping by the cap 51 coming into close contact with the nozzle surface 122 of the print head 2 can prevent the nozzles from being dry.

During the cleaning operation shown in FIG. 13B, the head positioning member 81 comes into contact with the first-direction contact surface 77 in the first direction, and the head positioning member 81 comes into contact with the first third-direction contact surface 73 in the third direction. During the cleaning operation, the end portions of the suction ports 11*a*, 11*b* have contact with the nozzle surface 122 of the print head 2. The suction wiper unit 46 is transported, as well as the suction ports, in the second direction while the negative pressure generating unit produces a negative pressure in the suction ports 11*a*, 11*b*, whereby ink and wastes adhered to the nozzle surface 122 are sucked and removed through the suction ports.

Figure 14:
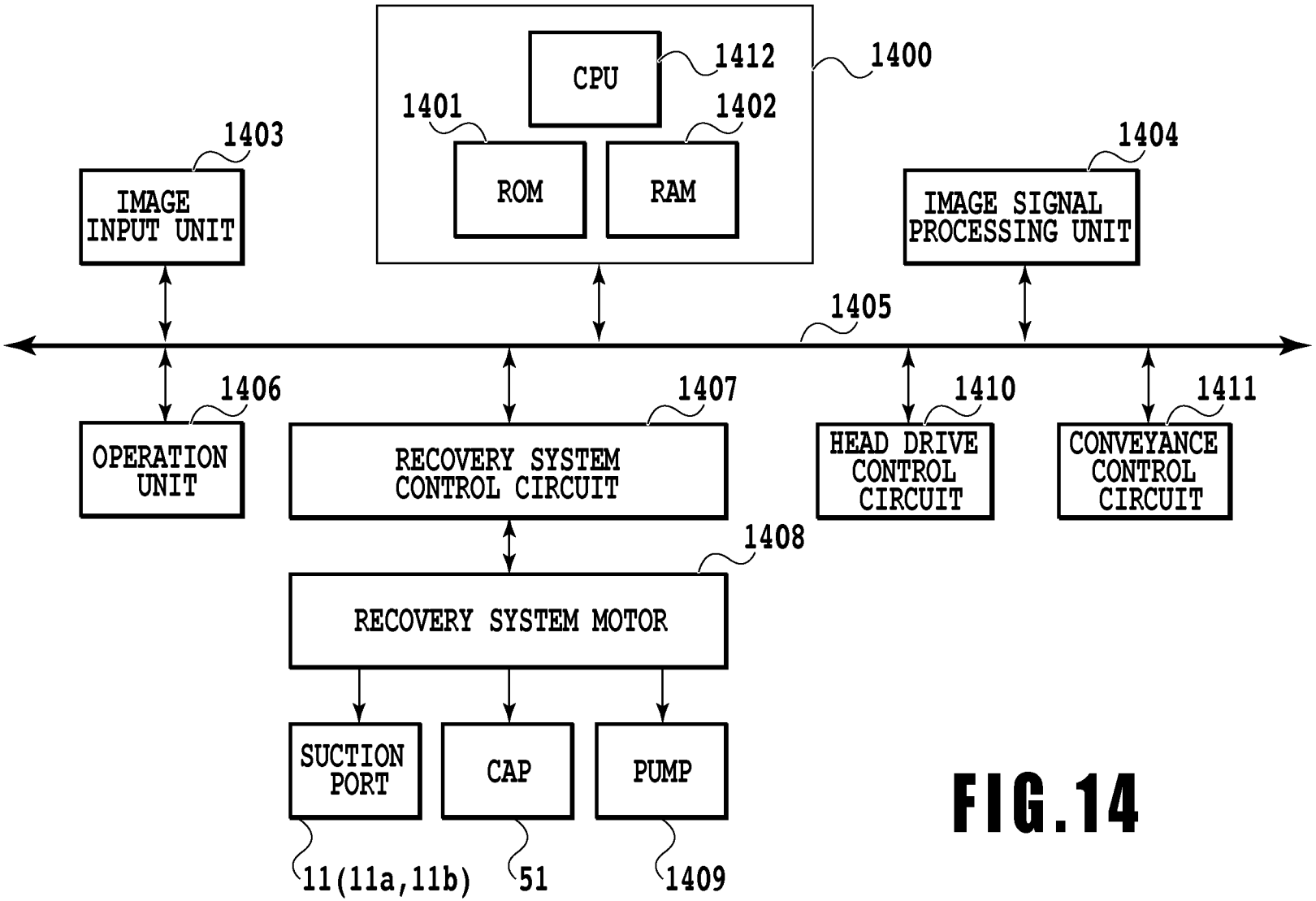
FIG. 14 is a block diagram of a control system of the printing apparatus.

FIG. 14 is a block diagram of a control system of the ink jet printing apparatus of the present example. The control system is broadly divided into a software system processing unit and a hardware system processing unit. The software system processing unit includes an image input unit 1403, an image signal processing unit 1404 corresponding thereto, and a central control unit 1400. These units access a main bus line 1405. The hardware system processing unit includes an operation unit 1406, a recovery system control circuit 1407, a head drive control circuit 1410, and a conveyance control circuit 1411 for controlling conveyance of a print medium.

The central control unit 1400 has a CPU 1412, a ROM (read-only memory) 1401, and a RAM (random-access memory) 1402, and controls over the printing apparatus including the print heads 2 based on input information, representing appropriate printing conditions, to print an image on a print medium. The central control unit 1400 includes a mode setting function for setting first and second control modes (described later), a function of selecting and performing the control modes, and a function of obtaining an ink viscosity in the print head. The RAM 1402 stores therein various programs in advance. The programs include a program for executing a recovery timing chart of the print head 2, and as required, give conditions, for recovery processing (recovery conditions) to maintain a favorable ink ejection state in the print head 2, to the recovery system control circuit 1407. Examples of the recovery conditions include a condition for preliminary ejection which ejects ink not contributing to printing of an image from the print head 2 into the cap 51 (preliminary ejection). A recovery system motor 1408 transfers the print head 2, the suction port 11, and the cap 51, as described above, and also drives a suction pump 1409 that sucks ink from the suction port 11 and the cap 51. The head drive control circuit 1410 is used for driving the ejection energy generation elements of the print head 2, and causes the print head 2 to perform preliminary ejection and ink ejection for printing an image.

First Embodiment

Figure 15:
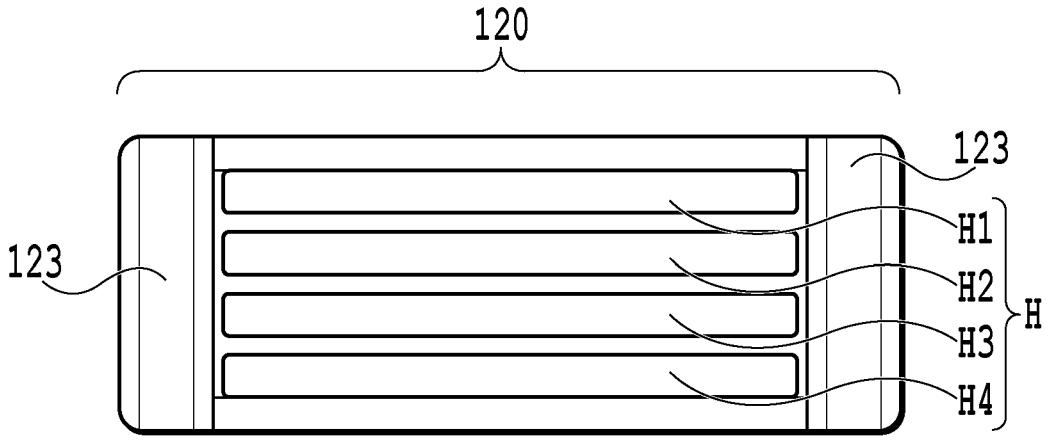
FIG. 15 is a view illustrating a nozzle chip according to a first embodiment of the present invention.

A first embodiment of the present invention is based on the basic configuration of the printing apparatus as described above. To control the temperature of the nozzle chip 120 of the print head 2 in the present embodiment, the nozzle chip 120 of FIG. 5 as described above is provided with a sub-heater (nozzle chip heating unit) H as shown in FIG. 15. Four nozzle arrays 121 are formed on the nozzle chip 120 of FIG. 5, and as the sub-heater H, a total of four sub-heaters H1, H2, H3, and H4 are arranged at positions around the respective nozzle arrays 121. During image printing, the sub-heater H is heated so that the nozzle chip 120 is adjusted to have a desired temperature, whereby a viscosity of ink is lowered to allow accurate ejection even in a case where ink with a relatively high viscosity is used. In the present example, a maximum viscosity of ink that can be stably ejected is about 6 cP. At this time, an ink maximum ejection frequency (corresponding to a maximum drive frequency of a print head) is about 12 kHz and a volume of an ink droplet ejected from a nozzle is about 5 pl.

The printing apparatus of the present embodiment can perform ink ejection operation (printing operation) for printing an image after recovery processing (recovery operation). The printing apparatus of the present embodiment includes first and second control modes that can be selected when a viscosity of ink is equal to or greater than a predetermined value, as control modes capable of controlling the recovery processing by recovery control and the ink ejection operation by print control during image printing in relation to each other. In the first control mode, a first recovery condition and a first printing condition for recovery processing and ejection operation are set. In the second control mode, a second recovery condition and a second printing condition for recovery processing and ejection operation are set. The first recovery condition is set such that a level of the recovery processing is greater compared to the second recovery condition. Meanwhile, the second printing condition is set such that ink can be ejected in a state with a lower viscosity compared to the first printing condition.

In the present example, under the first printing condition, a target regulated temperature (target temperature) of a nozzle chip is set to 35° C., and under the second printing condition, a target regulated temperature of a nozzle chip is set to 45° C. The temperature of the nozzle chip is detected by a temperature sensor such as a diode sensor provided on the nozzle chip, and the sub-heater H is controlled according to a difference between the detected current temperature and the target regulated temperature. More specifically, the sub-heater H is controlled such that a pulse voltage according to the difference between the temperatures is applied to the sub-heater H so that the temperature of the nozzle chip during printing operation (during ink ejection operation) is maintained at the target regulated temperature. This control can be made independently for the sub-heaters H1, H2, H3, and H4.

The target regulated temperature is set in consideration of an upper limit temperature at which ink can be stably ejected, a temperature profile of a nozzle chip during continuous printing, a heat dissipation characteristic of a print head, and the like. In the present example, the upper limit temperature at which ink can be stably ejected is 60° C. and in a case where the target regulated temperature is 35° C., the temperature of the nozzle chip does not reach 60° C. during continuous printing. Meanwhile, in a case where the target regulated temperature is 45° C., the temperature of the nozzle chip may reach 60° C. when a pattern with a large number of ink dots is continuously printed on a print medium corresponding to a few hundred pages. In this case, each time an image is printed on the print medium corresponding to a predetermined number of pages, there is a need for control such as setting a standby time for suspending the printing operation to suppress increase in the temperature of the nozzle chip.

Meanwhile, as described above, capping is performed on the nozzle by using the cap during non-printing to prevent the nozzle arrays in the print head from being dry and having wastes adhered thereto. The cap has an air communication passage for communication between the inside of the cap and the outside air so that change in pressure in the cap during capping does not cause backflow of ink from the nozzle into the print head. Also, a small amount of water permeates a cap forming member. Accordingly, the water content in the ink gradually evaporates from the nozzle even during capping, which may cause the ink to be thicker in the vicinity of the nozzle. Taking such a situation into consideration, prior to the printing operation after releasing the capping, recovery processing is performed in accordance with the level of thickening of ink.

More specifically, in a case where the level of thickening of ink is low, ink not contributing to printing of an image is ejected into the cap from the nozzle of the print head (preliminary ejection), so that the ink in the vicinity of the nozzle is discharged outside and new ink is supplied into the nozzle. Meanwhile, in a case where the level of thickening of ink is high, the preliminary ejection cannot sufficiently discharge the thickened ink, and may result in a decreased discharge efficiency of the thickened ink. In this case, a pressurizing recovery for forcibly pressurizing, from the inside of the print head, the ink in the nozzle to discharge the ink into the cap and the like, a suction recovery for sucking the ink from the nozzle into the cap by a sucking mechanism, or the like are performed. In a case where the printing apparatus has an ink circulating passage (described later), it is also possible to perform a method including collecting the thickened ink in the vicinity of the nozzle and replacing it with ink with an appropriate viscosity, or a method including adjusting the thickened ink to have an appropriate viscosity by using a thinner and supplying the resultant ink.

In the present embodiment, in a case where the level of thickening of ink in the nozzle is high, the suction wiping by the suction wiper unit 46 as described above is performed. The ink (waste ink) discharged by the preliminary ejection and the suction wiping is stored in a waste ink reserving portion. Since the suction wiping produces a large amount of waste ink compared to the preliminary ejection, frequently performing the suction wiping may increase running costs and shorten a product life of the printing apparatus due to an amount of reserved waste ink reaching the upper limit in an early stage.

Figure 16:
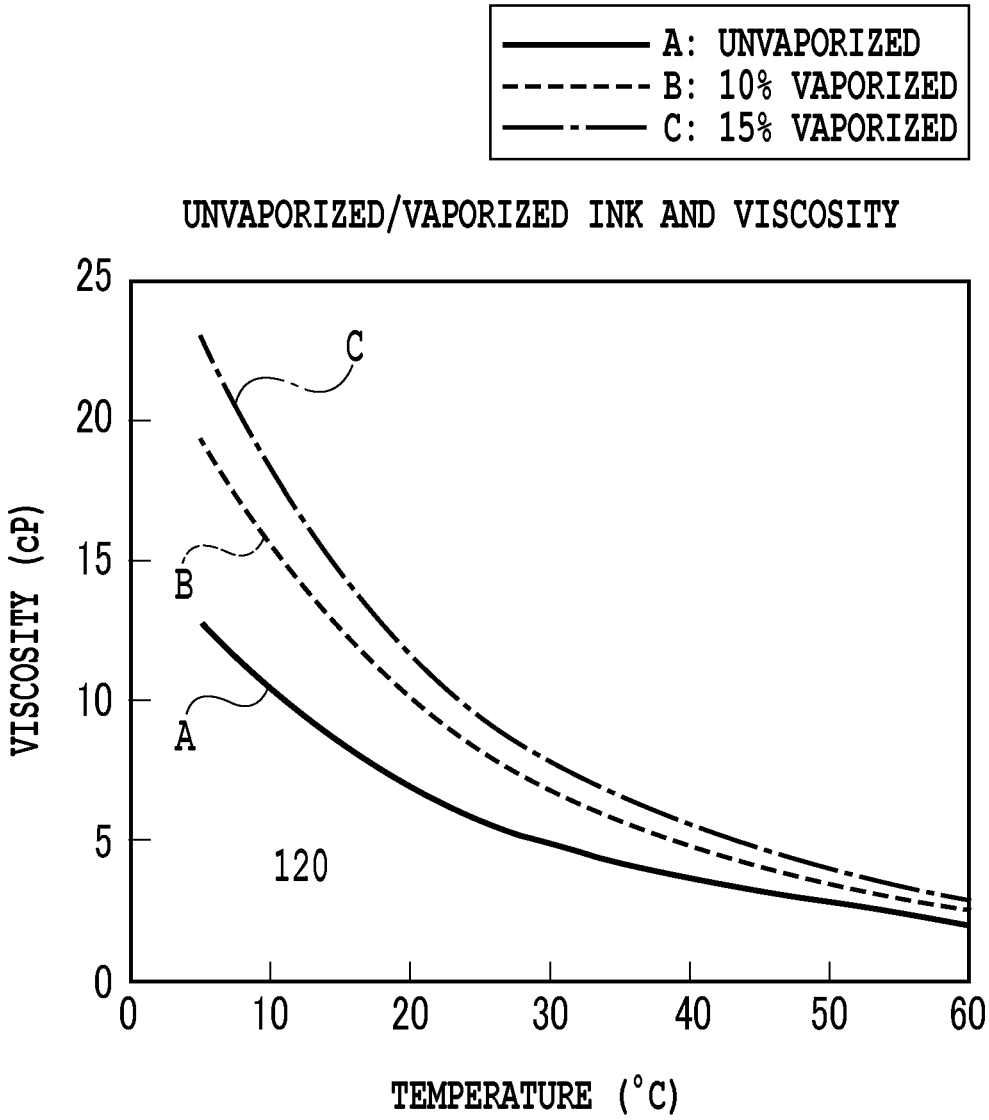
FIG. 16 is a graph illustrating the relation between a viscosity and a temperature of ink.

FIG. 16 is a graph illustrating the relation between a temperature and a viscosity of black ink (Bk) used in the present example. Curves A, B, and C respectively show change in viscosity of ink that has not been vaporized (unvaporized ink), change in viscosity of ink that has vaporized by 10% (10% vaporized ink), and change in viscosity of ink that has vaporized by 15% (15% vaporized ink). For example, at a temperature of 25° C., the unvaporized ink has a viscosity of 5.7 cP, the 10% vaporized ink has a viscosity of 8.3 cP, and the 15% vaporized ink has a viscosity of 9.1 cP. As described above, to stably eject ink, the viscosity needs to be equal to or lower than 6 cP. In a case where the temperatures of unvaporized ink, 10% vaporized ink, and 15% vaporized ink are regulated to be 35° C., their respective viscosities are close to 4 cP, 5.5 cP, and 7 cP. Accordingly, the 15% vaporized ink cannot be stably ejected at a target regulated temperature of 35° C. At a target regulated temperature of 40° C., however, the 15% vaporized ink has a viscosity of 5.5 cP, and can be stably ejected.

Figure 18:
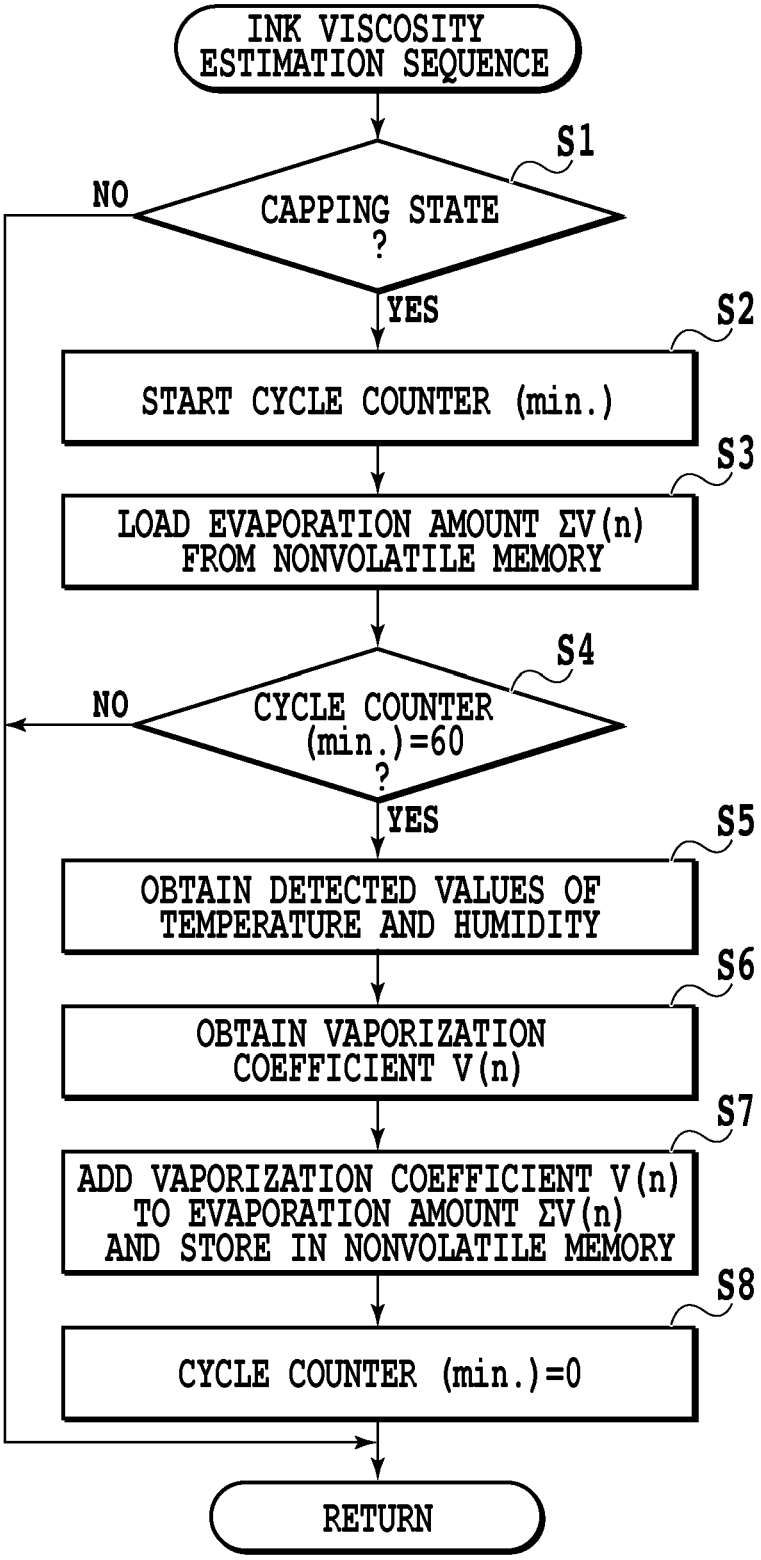
FIG. 18 is a flow chart for explaining an ink viscosity estimation sequence.

FIG. 17 and FIG. 18 are a table and a flow chart, respectively, for explaining a method of ink viscosity estimation in the print head of the present example.

A vaporization coefficient V in FIG. 17 is a coefficient obtained based on a rate of evaporation from the print head in environments with different temperature and humidity. It indicates that as the value increases, the evaporation amount increases. The vaporization coefficient V can be set by measuring the evaporation amount of water content evaporating from ink in environments with different temperature and humidity. As such, the environmental temperature and the environmental humidity are correlated with the evaporation amount.

FIG. 18 is a flow chart for explaining an ink viscosity estimation sequence. With the starting point at the start of the capping, a cycle counter (min.) that counts up in minutes is started (step S1, step S2), and then an evaporation amount ΣV(n) stored in nonvolatile memory of the printing apparatus is loaded (step S3). After one hour with the cycle counter reaching 60 (step S4), the environmental temperature and the environmental humidity are obtained by a temperature-humidity sensor placed inside the printing apparatus (step S5). Then, a vaporization coefficient V(n) corresponding to the environmental temperature and the environmental humidity is obtained from FIG. 17 (step S6). The vaporization coefficient V(n) is added to the evaporation amount ΣV(n) and the result is stored in the nonvolatile memory of the printing apparatus (step S7). The relation between the vaporization coefficient V(n) and the evaporation amount ΣV(n) is represented by the following equation:

$$\Sigma V(n)=V(0)+V(1)+\ldots V(n)$$

At the start of printing, with reference to the evaporation amount ΣV(n) that has been accumulated by the start of printing, appropriate recovery processing corresponding to the evaporation amount ΣV(n) is set so as to perform recovery processing in accordance with the level of thickening of ink in the print head. Most of the evaporation of water content in the ink happens from the end of the nozzle, and in an ink passage of the print head, the ink in the vicinity of the nozzle is very much thickened. As the distance from the nozzle increases, the level of thickening decreases. Therefore, in the present example, a viscosity of ink is estimated based on the evaporation amount of water content in the ink evaporating from the print head as described above. It should be noted that in a case where the level of thickening of ink is averaged in the ink passage of the print head like the configuration including an ink circulating passage (described later) and the like, the viscosity of ink may also be estimated based on an evaporation rate of water content in the ink.

FIG. 19A is a table illustrating the relation between first and second control modes and a target regulated temperature (ejection condition) in the present example. FIG. 19B and FIG. 19C are tables illustrating the relation between an evaporation amount ΣV(n), a condition for recovery processing (recovery condition), and a recovery amount in the first and second control modes.

In the case of the first control mode, when the evaporation amount ΣV(n) is equal to or greater than 0 and less than 360, printing is started after ejecting 1000 ink droplets (a recovery amount of 0.10 g per ink of one color) through the preliminary ejection. When the evaporation amount ΣV(n) is equal to or greater than 360 and less than 720, printing is started after ejecting 2000 ink droplets (a recovery amount of 0.20 g per ink of one color) through the preliminary ejection. These recovery amounts can be experimentally obtained as an ink discharge amount necessary for stably ejecting ink under a condition of a target regulated temperature of 35° C. in the first control mode. After performing such recovery processing (preliminary ejection), the evaporation amount ΣV(n) is reset.

Furthermore, since the level of thickening of ink is high when the evaporation amount ΣV(n) is equal to or greater than 720 in the first control mode, the suction wiping, instead of the preliminary ejection, is performed as the recovery processing. The thickened ink may also be discharged by increasing the number of ink ejections by the preliminary ejection. However, such preliminary ejection may put the printing apparatus under heavy load, such as increase in the temperature of the print head, contamination of the inside of the printing apparatus by ink mist, and the like. Accordingly, when the evaporation amount ΣV(n) is equal to or greater than a predetermined value, it is desirable to perform recovery processing without ink ejection.

In view of the above, in the present example, when the evaporation amount ΣV(n) is equal to or greater than 720 and less than 1200, printing is started after performing suction wiping for sucking ink in an amount of 0.33 g per ink of one color as the recovery processing. When the evaporation amount ΣV(n) is equal to or greater than 1200, printing is started after performing high-power suction wiping for sucking ink in an amount of 0.66 g per ink of one color. In the high-power suction wiping, a higher negative pressure for sucking ink is exerted or a lower wiping speed is set compared to the suction wiping, and a suction amount (recovery amount) of ink is greater compared to the suction wiping.

In the case of the second control mode, no particular recovery condition is set when the evaporation amount ΣV(n) is equal to or greater than 0 and less than 720, and the recovery processing is performed as in the first control mode. The reason is that even if the recovery processing is performed as in the first control mode, a recovery amount is relatively small. More specifically, when the evaporation amount ΣV(n) is equal to or greater than 0 and less than 360, 1000 ink droplets are ejected through the preliminary ejection, and when the evaporation amount ΣV(n) is equal to or greater than 360 and less than 720, 2000 ink droplets are ejected through the preliminary ejection. When the evaporation amount ΣV(n) is equal to or greater than 0 and less than 720, recovery processing may be performed at a smaller level or may not be performed. This is because a target regulated temperature (45° C.) in the second control mode is higher than a target regulated temperature (35° C.) in the first control mode by 10° C., and accordingly it is possible to lower a viscosity of ink even if having a higher evaporation rate, and to stably eject the ink with a lower viscosity.

When the evaporation amount ΣV(n) is equal to or greater than 720 and less than 1200, printing is started after ejecting 2000 ink droplets (a recovery amount of 0.20 g per ink of one color) through the preliminary ejection. Since suction wiping for sucking ink in an amount of 0.33 g per ink of one color is performed in the first control mode, it is possible to reduce a recovery amount as compared to the first control mode. This is because a target regulated temperature (45° C.) in the second control mode is higher than a target regulated temperature (35° C.) in the first control mode by 10° C., and accordingly it is possible to lower a viscosity of ink even if having a higher evaporation rate, and to stably eject the ink with a lower viscosity. Meanwhile, in the second control mode, the temperature of the nozzle chip may exceed a temperature at which ink can be stably ejected during continuous printing. In such a case, each time an image is printed on a print medium corresponding to a predetermined number of pages, a standby time for suspending the printing operation is set to suppress increase in the temperature of the nozzle chip. Furthermore, in the second control mode, when the evaporation amount ΣV(n) is equal to or greater than 1200, thickening of ink has proceeded to some extent, and thus printing is started after performing suction wiping for sucking ink in an amount of 0.33 g per ink of one color.

Figure 20:
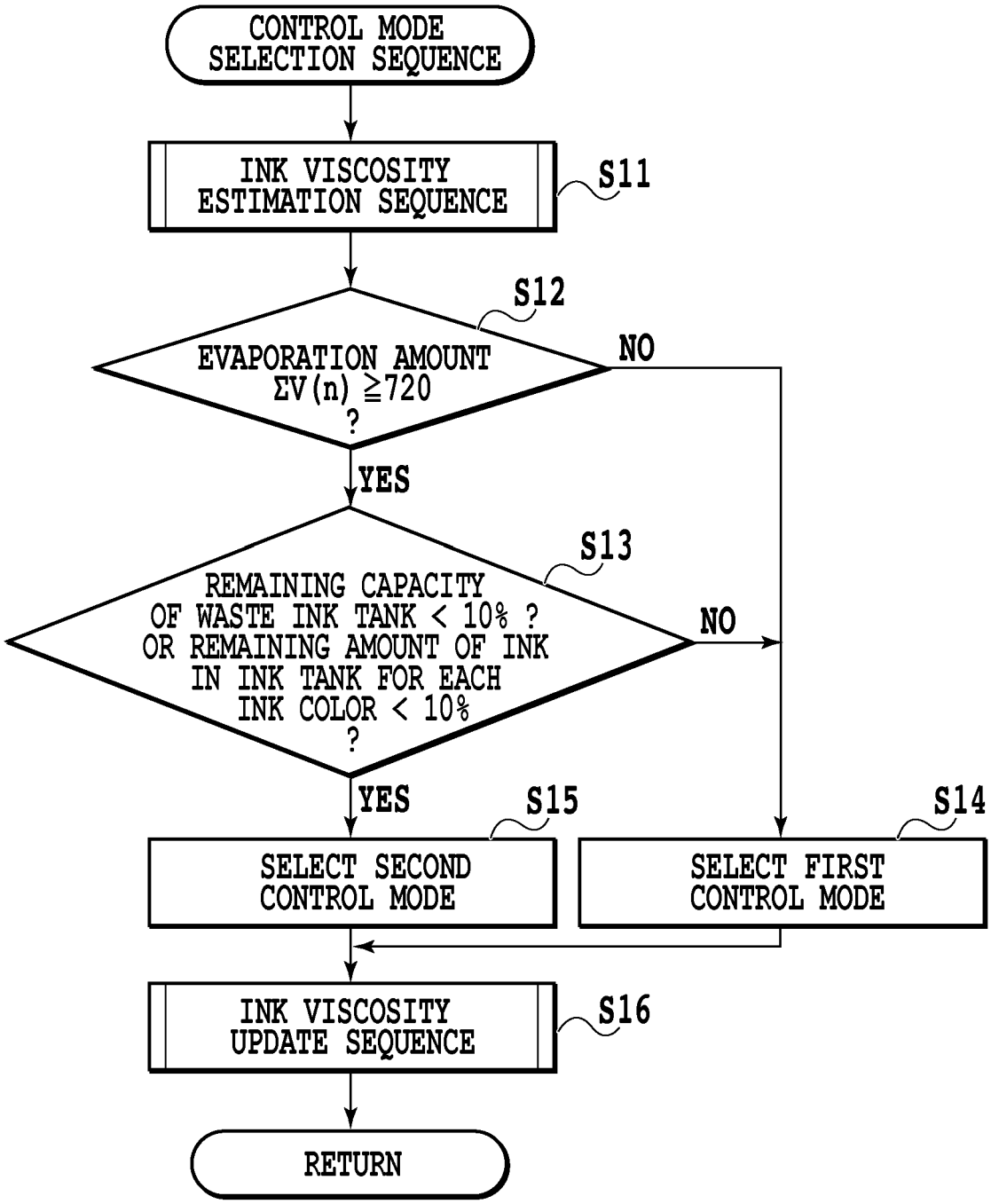
FIG. 20 is a flow chart for explaining a control mode selection sequence.

FIG. 20 is a flow chart for explaining a control mode selection sequence in the present example.

First, an evaporation amount ΣV(n) of ink evaporating from the print head is obtained by the ink viscosity estimation sequence of FIG. 18 as described above (step S11). It is determined whether the evaporation amount ΣV(n) is equal to or greater than 720 (step S12). If the result is a positive determination, the process proceeds to step S13, and if the result is a negative determination, the first control mode is selected (step S14). In step S13, it is determined whether a remaining capacity for waste ink in a waste ink tank (waste liquid container) containing waste ink at this point is less than 10%, or whether a remaining amount of ink in an ink tank (liquid reserving portion) for each ink color is less than 10%. If the result is a positive determination, the second control mode is selected (step S15), and if the result is a negative determination, the first control mode is selected (step S14). After selecting the first or second control mode, the process proceeds to an ink viscosity update sequence shown in FIG. 21 (step S16). Determination standards for the capacity of the waste ink tank and the remaining amount of ink in the ink tank are not specified as 10%, and may be set to any predetermined value according to the type of printing apparatus and the like.

Figure 21:
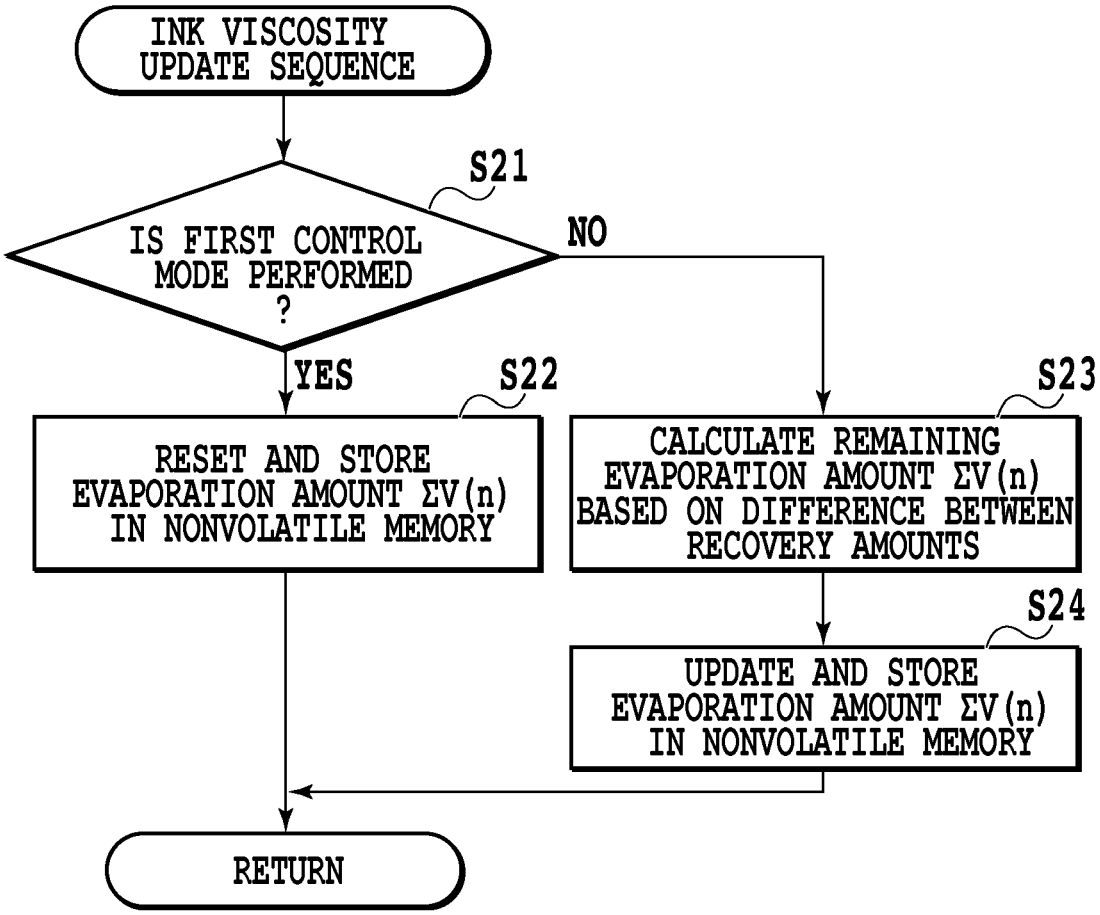
FIG. 21 is a flow chart for explaining an ink viscosity update sequence.

In the ink viscosity update sequence shown in FIG. 21, first, it is determined whether the control mode as performed is the first control mode (step S21) or not. If the result is a positive determination, the evaporation amount ΣV(n) is reset and stored in nonvolatile memory (step S22). If the result is a negative determination, it means that the second control mode has been performed. As described above, in the second control mode, an image is printed by maintaining the nozzle chips at a high temperature while suppressing an ink consumption amount (recovery amount) along with the recovery processing as compared to the first control mode. Since a level of the recovery processing is relatively small in the second control mode, ink with a high viscosity may remain in the print head after performing the second control mode as compared to the case after performing the first control mode. Accordingly, after performing the second control mode, an evaporation amount that is remaining (remaining evaporation amount) ΣV(n) is calculated from a difference between the recovery amounts in the first and second control modes (step S23). The remaining evaporation amount ΣV(n) can be obtained, for example, by the following equation:

$$\text{Remaining evaporation amount } \Sigma V(n)=k\times\{(\text{recovery amount in first control mode})-(\text{recovery amount in second control mode})\}$$

The coefficient k is an experimentally obtainable coefficient, and k=3600 in the present example. The vaporization coefficient V of FIG. 17 may be normalized so as to satisfy the coefficient k=1. The evaporation amount ΣV(n) calculated in step S23 is stored in the nonvolatile memory (step S24).

In the present embodiment as described above, in a case where the evaporation amount ΣV(n) is equal to or greater than 720 and a remaining capacity for waste ink in the waste ink tank and a remaining amount of ink in the ink tank for each ink color are not sufficient, the second control mode is automatically selected. This can continue printing of an image while suppressing an ink consumption amount, a recovery processing time, and a waste ink amount along with the recovery processing as compared to the first control mode. In the present embodiment, the viscosity of ink has been estimated by the ink viscosity estimation sequence. However, a sensor capable of measuring a viscosity or a thickening level of ink may be installed in the print head and the ink passage. The control modes are not limited to the first and second control modes. Control modes having different ejection conditions and recovery conditions may also be set.

Second Embodiment

A method for selecting a control mode is not limited to the selection method based on the evaporation amount of water content in ink, the remaining capacity of the waste ink tank, and the remaining amount of ink in the ink tank for each ink color like the first embodiment. In the present embodiment, conditions for selecting a control mode include a print mode.

Figure 22:
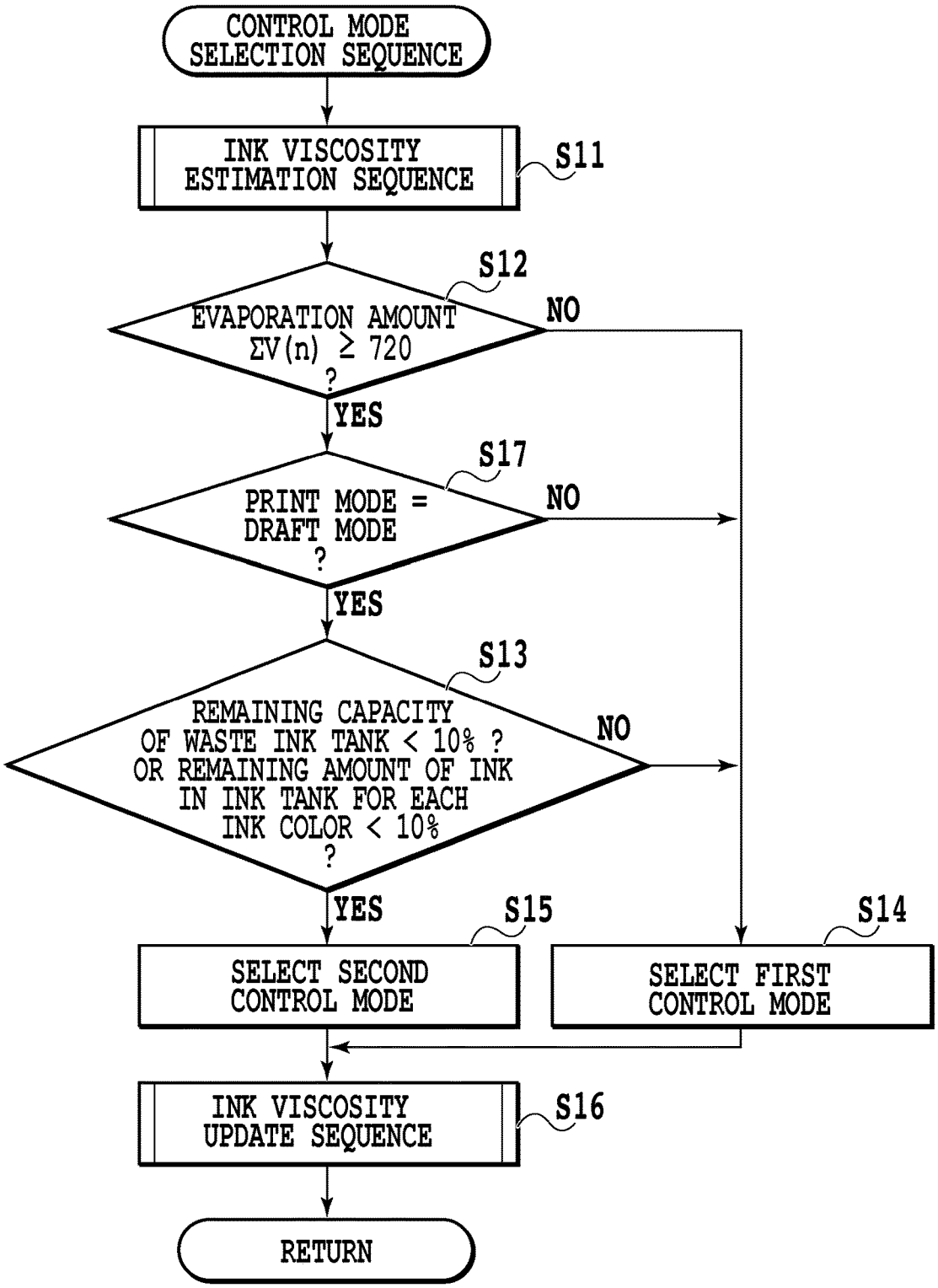
FIG. 22 is a flow chart for explaining a control mode selection sequence according to a second embodiment of the present invention.

More specifically, in a case where a draft mode which focuses on a print speed rather than a quality of printed images or the like is set as the print mode, the second control mode which can shorten the time required by the end of printing is preferred to the first control mode. Meanwhile, in a case where a high image quality mode (printing operation mode) which focuses on a quality of printed images is set as the print mode, the first control mode is preferable. FIG. 22 is a flow chart for explaining a control mode selection sequence according to the present example. It is determined whether the print mode is the draft mode between step S12 and step S13 in the selection sequence shown in FIG. 20 in the above-described first embodiment (step S17). In a case where the print mode is the draft mode, the process proceeds to step S13. In a case where the print mode is a mode other than the draft mode, the first control mode is selected (step S14).

Third Embodiment

Figure 23:
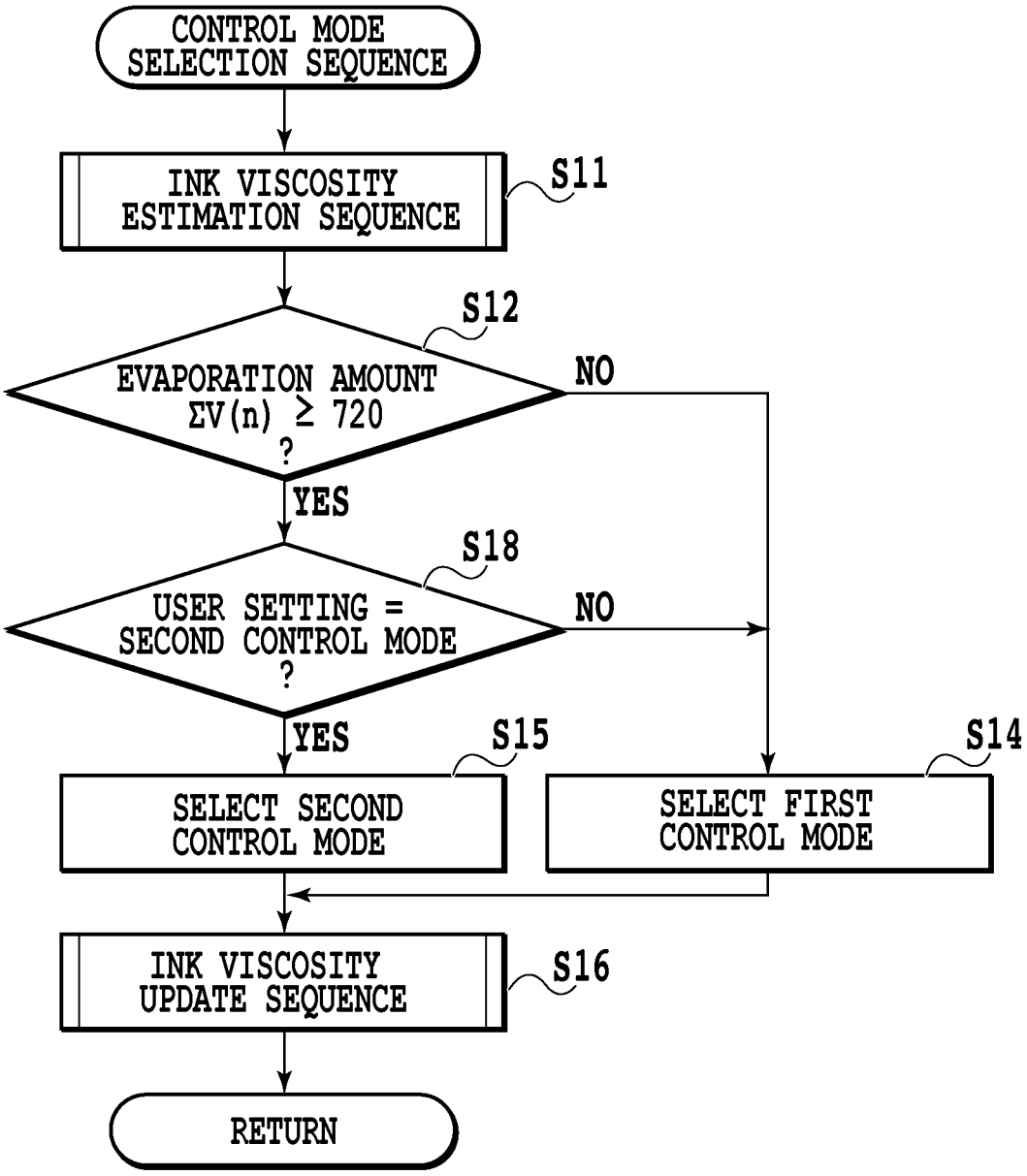
FIG. 23 is a flow chart for explaining a control mode selection sequence according to a third embodiment of the present invention.

In the present embodiment, a control mode specified in advance by a user is selected as a control mode when an ink viscosity exceeds a predetermined value. The user can store the specified control mode in the printing apparatus by a printer driver or the like. FIG. 23 is a flow chart for explaining a control mode selection sequence according to the present example. In the present example, instead of step S13 in FIG. 20 in the above-described first embodiment, step S18 is performed. In step S18, it is determined whether the second control mode is specified by the user in advance as a control mode when an ink viscosity exceeds a predetermined value (corresponding to an evaporation amount $\Sigma V(n) \geq 720$). In a case where the second control mode is specified in advance, the process proceeds to step S15. Otherwise, the first control mode is selected (step S14).

Fourth Embodiment

The plurality of control modes in the first embodiment have different target regulated temperatures as ejection conditions. A plurality of control modes in the present embodiment have not only different target regulated temperatures but also different ink maximum ejection frequencies (corresponding to maximum drive frequencies of the print head) as the ejection conditions.

Figures 24A, 24B:
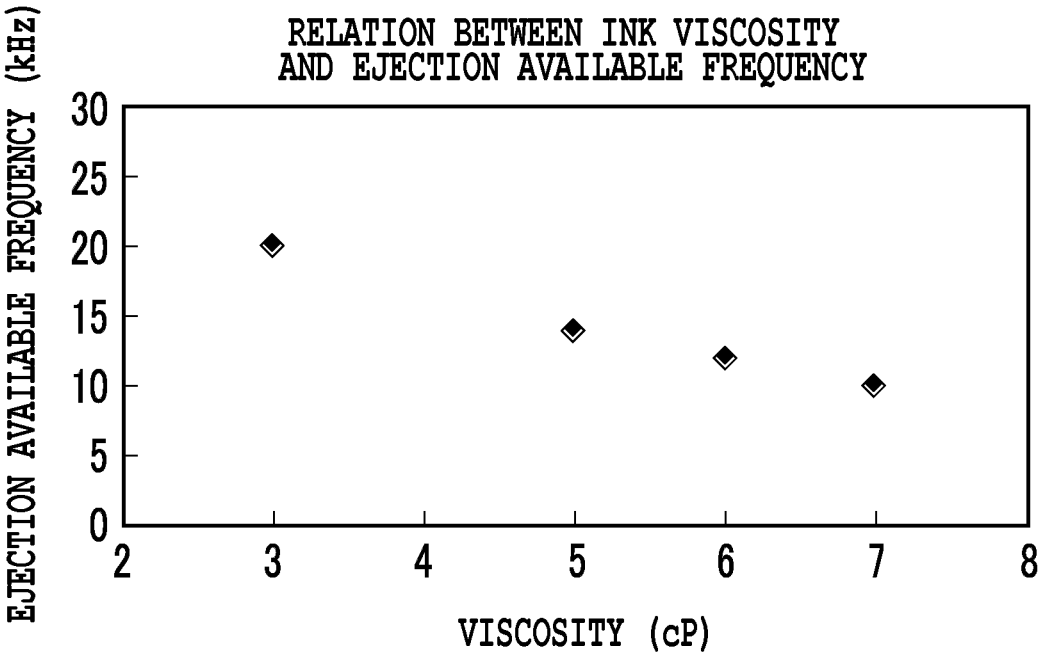
FIG. 24A is a table illustrating the relation between first and second control modes, a target regulated temperature, and an ink maximum ejection frequency according to a fourth embodiment of the present invention.
FIG. 24B is a graph illustrating the relation between an ink viscosity and a maximum ejection frequency according to the fourth embodiment of the present invention.

FIG. 24A is a table illustrating the relation between first and second control modes, a target regulated temperature, and an ink maximum ejection frequency according to the present example. In the print head of the present example, the maximum viscosity of ink that can be stably ejected is about 6 cP and the ink maximum ejection frequency at that time is about 12 kHz, as described above. Suppressing the maximum ejection frequency can increase the maximum viscosity of ink that can be stably ejected. FIG. 24B is a graph illustrating the relation between an ink viscosity and a maximum ejection frequency. For example, when the ink viscosity is 7 cP, the ejection frequency may be set to 10 kHz or lower. In the present example, the maximum ejection frequency in the first control mode is 12 kHz, and the maximum ejection frequency in the second control mode is 10 kHz. Selection between the first and second control modes may be based on the evaporation amount $\Sigma V(n)$ as in the first embodiment. The number of control modes is not limited to two. Another control mode having different ink ejection conditions may further be included. For instance, another control mode combining a target regulated temperature and an ejection frequency may also be included.

Fifth Embodiment

In the above-described first embodiment, the ink viscosity is estimated based on the evaporation amount of water content in ink evaporating from the print head as shown in FIG. 18. In the present embodiment, a configuration having a passage for circulating ink takes into consideration not only the evaporation amount of water content in ink but also a level of thickening of the entire ink in an ink circulating passage.

Figure 25:
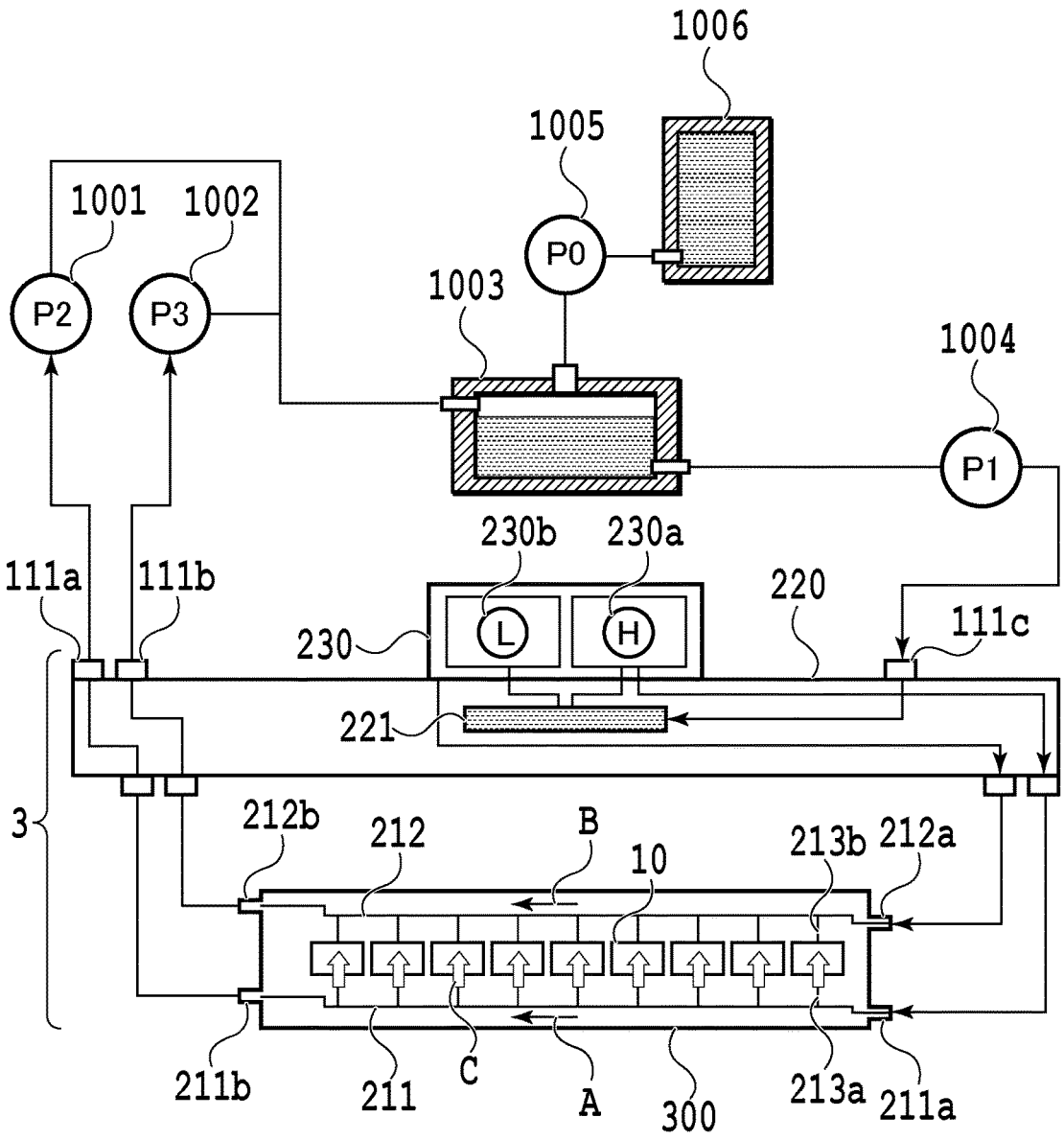
FIG. 25 is a view illustrating an ink circulating passage of the printing apparatus according to a fifth embodiment of the present invention.

FIG. 25 is a view illustrating an ink circulating passage applied to the printing apparatus of the present embodiment. In the present example, a printing unit 3 having a head (ejection head) 300 is fluidly connected with a first circulation pump (P2) 1001 on a high pressure side, a first circulation pump (P3) 1002 on a lower pressure side, a main tank 1003, and the like. For the sake of simplicity of description, FIG. 25 shows only one of four print heads 300 corresponding to four ink colors: cyan (C), magenta (M), yellow (Y), and black (K). In actuality, circulating passages corresponding to the respective inks of four colors are provided on the body of the printing apparatus. The main tank 1003 can discharge bubbles in the ink to the outside through an air communication port (not shown) for communication between the inside and the outside of the main tank 1003. The ink inside the main tank 1003 is consumed through image printing and recovery processing (including preliminary ejection, suction discharge, pressurized discharge, and the like), and is replaced when the tank becomes empty.

The print head 300 has a plurality of printing element boards 10. On each printing element board 10, a plurality of pressure chambers each communicating through an individual supply passage 213*a* and an individual collection passage 213*b* are formed between a common supply passage 211 and a common collection passage 212. Ink in each pressure chamber is ejected from an ejection port forming a nozzle by using an ejection energy generation element such as heat generating element. Through each pressure chamber, ink flows from the common supply passage 211 toward the common collection passage 212 in arrow C direction as will be described later.

The first circulation pump 1001 sucks the ink in the common supply passage 211 through a connection part 111*a* of a liquid supply unit 220 and an outlet 211*b* of the print head 300 and returns it to the main tank 1003. The first circulation pump 1002 sucks the ink in the common collection passage 212 through a connection part 111*b* of the liquid supply unit 220 and an outlet 212*b* of the print head 300 and returns it to the main tank 1003. For these first circulation pumps, a positive-displacement pump having a constant liquid delivery capacity is preferable. Examples of such a pump include a tube pump, a gear pump, a diaphragm pump, a syringe pump, and the like. It is also possible to secure a constant flow rate by installing a general constant flow valve or a relief valve on the outlet of the pump. When driving the print head 300, the first circulation pumps 1001 and 1002 cause a constant volume of ink to flow in arrow A and arrow B directions in FIG. 25 through the common supply passage 211 and the common collection passage 212, respectively. The flow rate is a volume that can be reduced to an extent that a temperature difference between the printing element boards 10 does not affect the quality of printed images. However, in a case where the flow rate is too large, an influence of pressure on the flow passage in the print head 300 may cause uneven density in the printed images because a difference in negative pressure between the printing element boards 10 becomes too large. Therefore, it is preferable to set the flow rate of ink in the common supply passage 211 and the common collection passage 212 by taking a temperature difference and a negative pressure difference between the printing element boards 10 into consideration.

A negative pressure control unit 230 is provided on the flow passage between a second circulation pump (P1) 1004 and the print head 300. The negative pressure control unit 230 has a function of maintaining pressure of ink on the print head 300 side constant even in a case where the flow rate of ink in an ink circulatory system changes according to a print duty of a printed image. Two pressure regulation mechanisms 230*a*, 230*b* forming the negative pressure control unit 230 may employ any mechanism as long as they have a configuration capable of controlling pressure in the flow passage downstream of the pressure regulation mechanisms 230*a*, 230*b* to be within a constant range around a desired set pressure. As an example, the same mechanism as a so-called "pressure-reducing regulator" may be employed. In a case where the pressure-reducing regulator is used, it is preferable that the second circulation pump 1004 pressurizes the flow passage upstream of the negative pressure control unit 230 through the liquid supply unit 220 as shown in FIG. 25. This can suppress an influence of a head pressure between the main tank 1003 and the print head 300, thereby increasing flexibility of layout of the main tank 1003 in the printing apparatus. The second circulation pump 1004 is connected to the pressure regulation mechanisms 230*a*, 230*b* via a connection part 111*b* of the liquid supply unit 220 and a filter 221. The second circulation pump 1004 may be any pump as long as it has a head pressure not less than a given constant pressure within a range of a circulation flow rate of ink when driving the print head 300. A turbo pump, a positive-displacement pump, or the like may be used. For example, a diaphragm pump or the like may be applicable. Instead of the second circulation pump 1004, a head tank installed with a given constant head difference with respect to the negative pressure control unit 230 may also be applicable.

In the two pressure regulation mechanisms 230*a*, 230*b* in the negative pressure control unit 230, different control pressures are set. The pressure regulation mechanism 230*a* is shown by "H" in FIG. 25 since a relatively high pressure is set, whereas the pressure regulation mechanism 230*b* is shown by "L" in FIG. 25 since a relatively low pressure is set. The pressure regulation mechanism 230*a* is connected to an inlet 211*a* of the common supply passage 211 in the print head 300 through the inside of the liquid supply unit 220. The pressure regulation mechanism 230*b* is connected to an inlet 212*a* of the common collection passage 212 in the print head 300 through the inside of the liquid supply unit 220.

The inlet 211*a* of the common supply passage 211 is connected to the pressure regulation mechanism 230*a* on the high pressure side, and the inlet 212*a* of the common collection passage 212 is connected to the pressure regulation mechanism 230*b* on the low pressure side. Accordingly, a pressure difference is generated between the common supply passage 211 and the common collection passage 212. Therefore, part of ink flowing in the arrow A and arrow B directions through the common supply passage 211 and the common collection passage 212 flows in the arrow C direction through the individual supply passage 213*a*, the pressure chamber (not shown), and the individual collection passage 213*b*.

As such, in the print head 300, the ink flows in the arrow A and arrow B directions through the common supply passage 211 and the common collection passage 212, while part of the ink flows in the arrow C direction to pass through the printing element boards 10. Accordingly, the flow of the ink in the common supply passage 211 and the common collection passage 212 allows heat generated in the printing element boards 10 to be discharged outside. Further, such configuration causes the ink to flow also in ejection ports and pressure chambers that do not eject ink during the printing operation and allows suppression of thickening of the ink in the ejection ports and the pressure chambers. Moreover, the thickened ink and foreign matter in the ink can be discharged outside through the common collection passage 212. As a result, using the print head 300 can print a high-quality image at high speed.

(Concentration Estimation in the Circulating Passage)

In the case where the printing apparatus having the circulating passage as shown in FIG. 25 is used, even if thickening (increase in a concentration) of ink occurs in the vicinity of ejection ports, circulation of the ink can remove the thickened ink from the vicinity of the ejection ports through the circulating passage. This can avoid the advance of thickening only in the vicinity of the ejection ports, but circulation causes thickening to gradually proceed throughout the circulating passage. As a level of thickening, that is a concentration, increases, an ink viscosity also increases.

Therefore, the concentration of ink in the circulating passage is estimated in the present embodiment, and the estimated concentration is used as information relating to the viscosity of ink. In other words, a control mode is selected based on the information representing the concentration of ink in the circulating passage. Here, in the present embodiment, information relating to an evaporation amount of ink in the circulating passage, information relating to an ink consumption amount in the circulating passage, information relating to an initial amount of ink in the circulating passage are acquired (acquire an evaporation amount, acquire a consumption amount, and acquire an initial amount), and concentration information of ink in the circulating passage is acquired based on the aforementioned information (acquire concentration).

Note that the subsequent processing is performed individually for each ink of color. Hereinafter, only the processing for ink of a certain color will be described for the sake of simplicity of description.

1. Evaporation Amount of Ink in the Circulating Passage

In the present embodiment, an evaporation amount Vx during printing operation and an evaporation amount Vy during non-printing operation are first calculated, and the sum of them is expressed by a total evaporation amount V(Vx+Vy). It should be noted that in the present embodiment, to calculate an evaporation amount V before and after (N(x)→N(x+1)) processing which updates a concentration of ink in the circulating passage as will be described later, calculation processing of the evaporation amounts Vx, Vy is performed.

Figure 26:
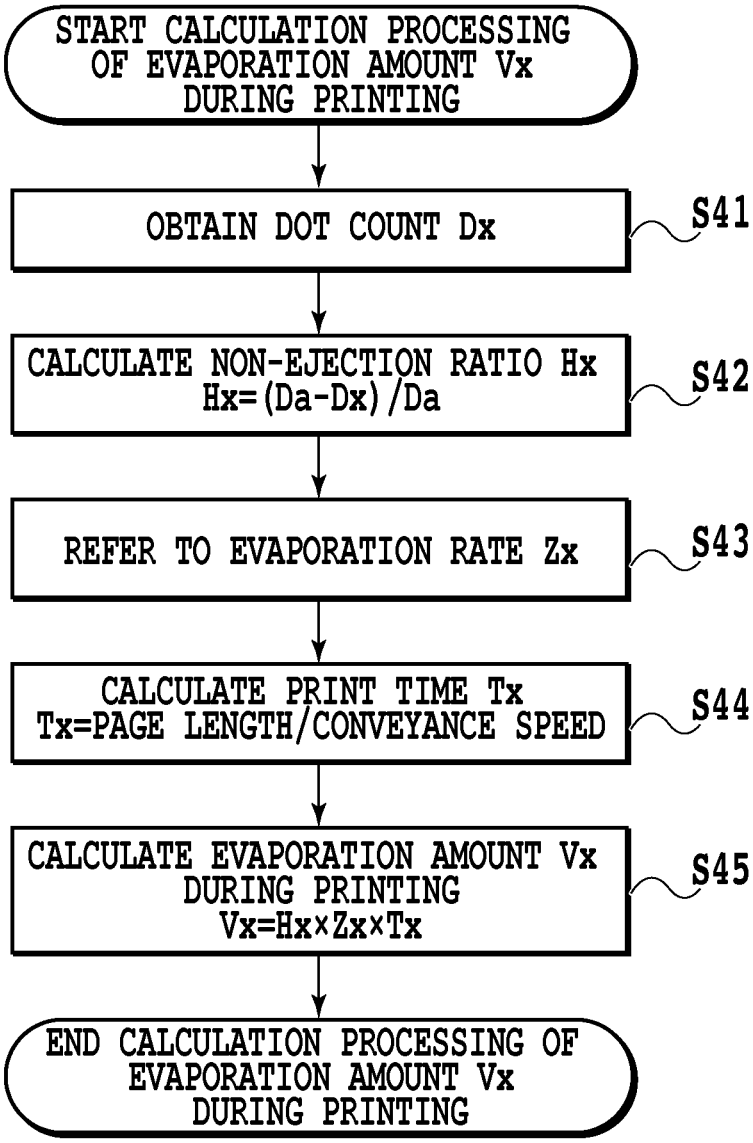
FIG. 26 is a flow chart showing a method for calculating an evaporation amount during printing according to the fifth embodiment.

First, to calculate the evaporation amount Vx of ink of each color during printing operation, a non-ejection ratio Hx, an evaporation rate Zx, and a print time Tx are calculated for ink of each color. FIG. 26 is a flow chart showing calculation processing of the evaporation amount Vx during printing operation performed by a control program according to the present embodiment.

Once calculation processing of the evaporation amount Vx during printing is started after receiving print start information, first in step S41, the number of ejections of ink of each color in a page is counted (dot counting) based on print data used for printing, and a dot count Dx of ink is calculated.

Then, in step S42, a non-ejection ratio Hx of ink of each color is calculated. The non-ejection ratio Hx corresponds to a ratio of pixels in which ink is not ejected to pixels in which ink can be ejected. More specifically, given that complete ejection performed by all ejection ports for each color is indicated by 1, the non-ejection ratio Hx is a value obtained by subtraction of an actual dot count (the number of dot actually formed by ink ejected from ejection ports) Dx from a dot count Da in the case of complete ejection, and division of the result by the dot count Da in the case of complete ejection. In the present embodiment, the non-ejection ratio Hx is calculated for ink of each color.

In the next step S43, an evaporation rate Zx of ink is referenced. Here, an evaporation amount per second is measured in advance, and the measured evaporation amount is stored in a heating table storage memory 314 as the evaporation rate Zx. It should be noted that as a temperature increases, evaporation is more likely to occur, and thus a value of the evaporation rate Zx is greater. Table 1 shows details of the evaporation rate Zx in the present embodiment. In a case where a heater board has a temperature lower than 25° C., the evaporation rate is expressed by Zx=40 μg/sec. In a case where the heater board has a temperature equal to or higher than 25° C. and lower than 40° C., the evaporation rate is expressed by Zx=150 μg/sec. In a case where the heater board has a temperature equal to or higher than 40° C., the evaporation rate is expressed by Zx=420 μg/sec.

TABLE 1

| Evaporation rate [μg/sec] | Regulated temperature [° C.] <25 | <40 | 40≤ |
|---|---|---|---|
| Zx | 40 | 150 | 420 |

In the next step S44, a print time Tx required for printing one page is calculated. More specifically, the print time Tx is obtained by dividing a conveyance speed by a length corresponding to one page. Then in step S45, the evaporation amount Vx during printing operation is calculated. More specifically, the evaporation amount in the one page is calculated by multiplication of the non-ejection ratio Hx, the evaporation rate Zx, and the print time Tx. Then, the same processing is repeated on each page to calculate the evaporation amount Vx during printing operation.

Figure 27:
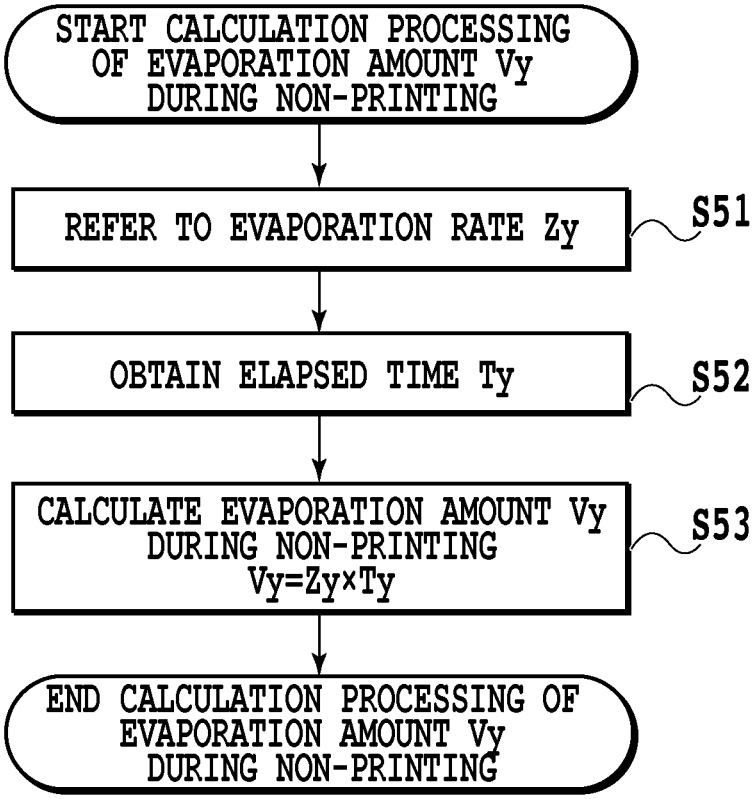
FIG. 27 is a flow chart showing a method for calculating an evaporation amount during non-printing according to the fifth embodiment.

Next, to calculate an evaporation amount Vy during non-printing operation of ink of each color, an evaporation rate Zy and an elapsed time Ty during non-printing operation are calculated for ink of each color. FIG. 27 is a flow chart showing calculation processing of the evaporation amount Vy during non-printing operation performed by a control program in the present embodiment.

Once calculation processing of the evaporation amount Vy during non-printing is started, first in step S51, an evaporation rate Zy of ink of each color is referenced. An evaporation amount per minute is measured in advance, and the measured evaporation amount is stored in the heating table storage memory 314 as the evaporation rate Zy during non-printing. As a temperature increases, evaporation is more likely to occur, and thus a value of the evaporation rate Zy is greater.

Here, since ejection ports of respective print heads 300 are covered by a capping member during non-printing operation, an evaporation rate during non-printing operation is smaller than an evaporation rate during printing operation for the same elapsed time. Table 2 shows details of the evaporation rate Zy in the present embodiment. In a case where a heater board has a temperature lower than 15° C., the evaporation rate is expressed by Zy=1 μg/min. In a case where the heater board has a temperature equal to or higher than 15° C. and lower than 25° C., the evaporation rate is expressed by Zy=2 μg/min. In a case where the heater board has a temperature equal to or higher than 25° C., the evaporation rate is expressed by Zy=5 μg/min.

TABLE 2

| Evaporation rate [μg/min] | Regulated temperature [° C.] <15 | <25 | 25≤ |
|---|---|---|---|
| Zy | 1 | 2 | 5 |

Next in step S52, an elapsed time Ty during non-printing operation is calculated. Then in step S53, the evaporation amount Vy during non-printing operation is calculated. More specifically, the evaporation amount Vy during non-printing operation is calculated by multiplication of the evaporation rate Zy and the elapsed time Ty. Then, the processing is completed.

The thus calculated evaporation amount Vx during printing operation and evaporation amount Vy during non-printing operation are added, and a total evaporation amount V is calculated.

2. Consumption Amount of Ink in the Circulating Passage

Figure 28:
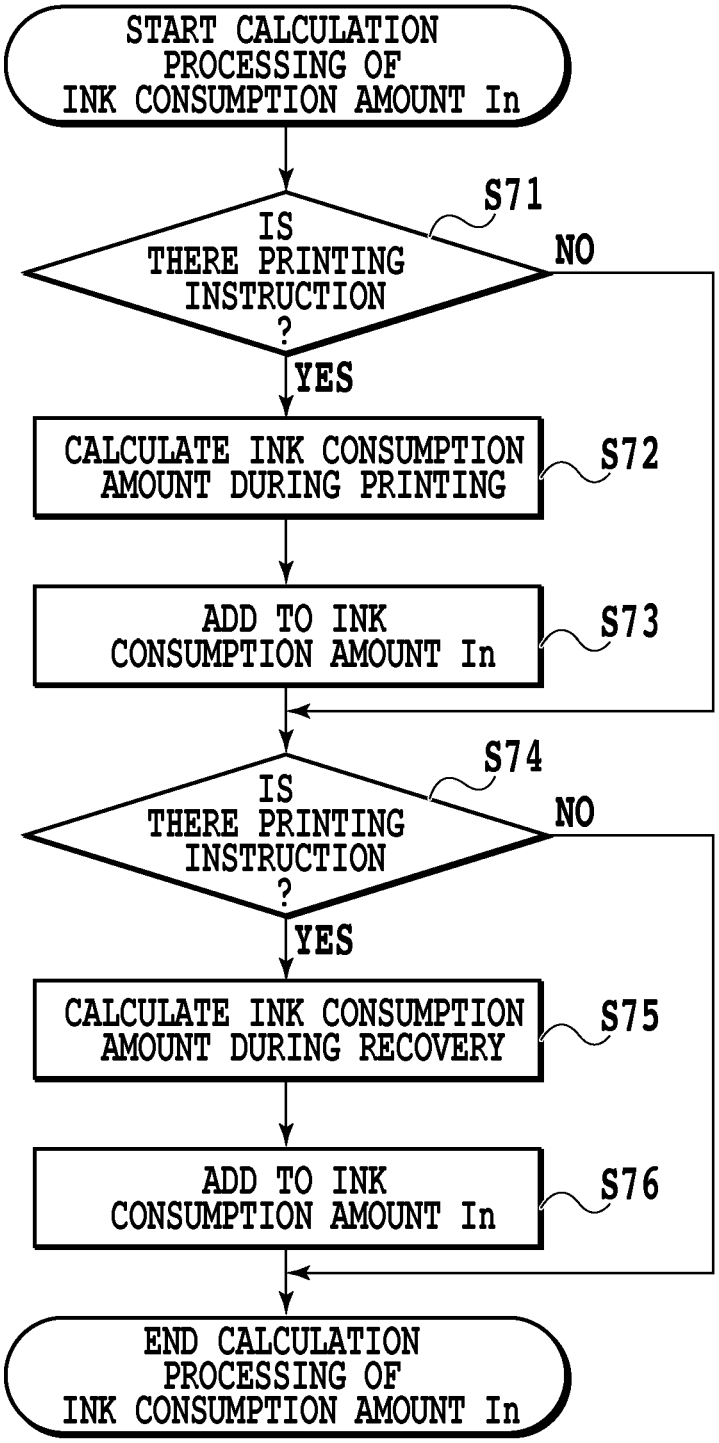
FIG. 28 is a flow chart showing a method for calculating an ink consumption amount according to the fifth embodiment.

Next, an ink consumption amount In during printing operation and non-printing operation is calculated. FIG. 28 is a flow chart showing calculation processing of the ink consumption amount In performed by a control program in the present embodiment.

Once calculation processing of an ink consumption amount is started, first in step S71, it is determined whether there is a printing instruction. If there is no printing instruction, the process proceeds to step S74 which will be described later. If there is a printing instruction, the process proceeds to step S72, and with reference to the consumption amount of ink used during printing obtained from dot counting and the like, an ink consumption amount during printing is calculated. After the calculation, in step S73, the ink consumption amount is added to the ink consumption amount In.

Next, in step S74, it is determined whether there is a recovery instruction. If there is no recovery instruction, calculation processing of the ink consumption amount In is completed. If there is a recovery instruction, the process proceeds to step S75. With reference to a recovery usage stored in advance in memory, in step S76, the recovery usage is added to the ink consumption amount In. Then, the calculation processing of the ink consumption amount In is completed.

As described above, in the present embodiment, each time there is a printing instruction or a recovery instruction, the ink consumption amount is added to the ink consumption amount In, whereby the ink consumption amount in the circulating passage can be managed.

3. Concentration of Ink in the Circulating Passage

Figure 29:
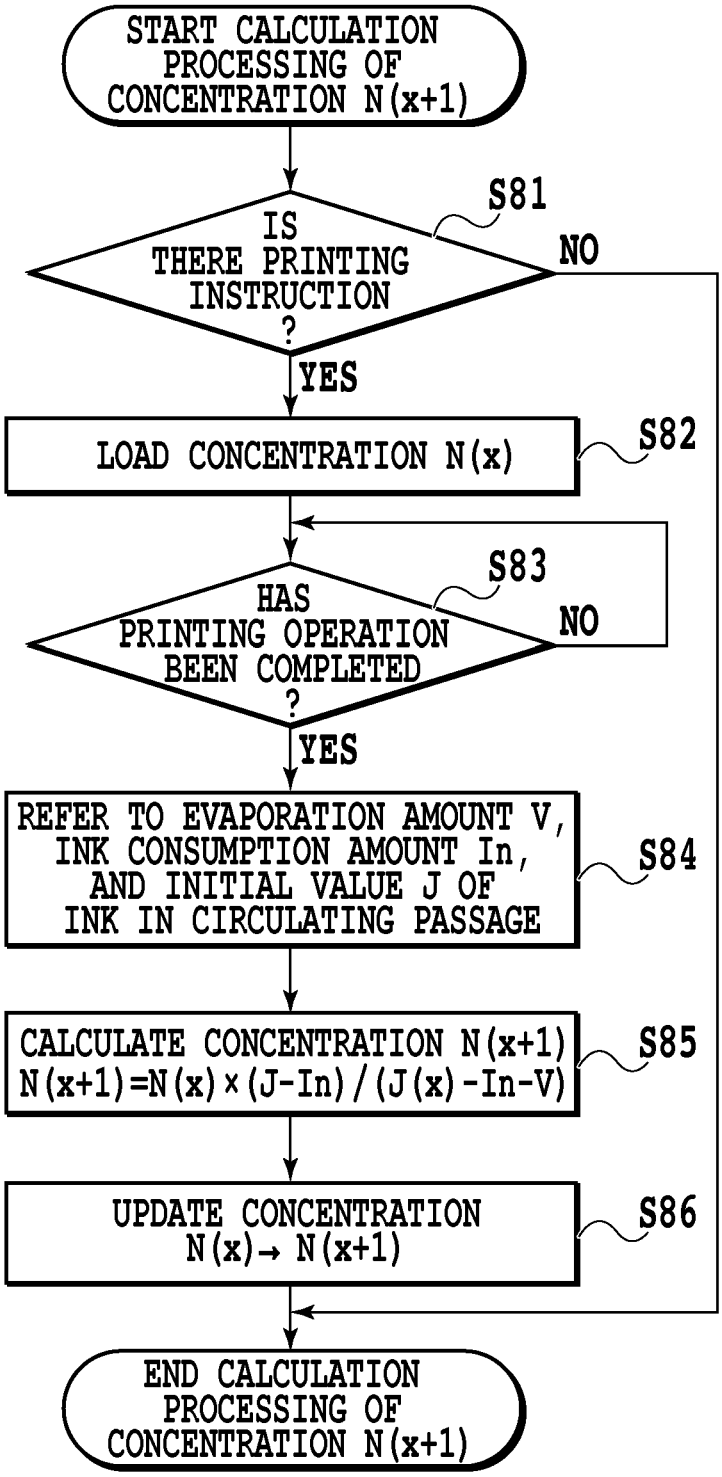
FIG. 29 is a flow chart showing a method for calculating a concentration according to the fifth embodiment.

In the present embodiment, the evaporation amount V and the ink consumption amount In calculated in the above manner are used to calculate a concentration in the circulating passage. FIG. 29 is a flow chart showing concentration calculation processing in the circulating passage performed by a control program in the present embodiment.

Once concentration calculation processing is started, first in step S81, it is determined whether there is a printing instruction. If there is no printing instruction, the processing is completed. If there is a printing instruction, the process proceeds to step S82, and a concentration N(x) that has already been calculated in the concentration calculation processing as performed earlier is loaded. It should be noted that the ink used in the present embodiment has an initial value of a concentration (initial concentration) Nref as shown in Table 3. Table 3 shows four initial concentrations Nref corresponding to four ink colors (cyan (Cy), magenta (Ma), yellow (Ye), and black (Bk)).

TABLE 3

| Color | Bk | Cy | Ma | Ye |
|---|---|---|---|---|
| Nref | 0.08 | 0.06 | 0.06 | 0.06 |

Next, in step S83, it is determined whether the printing operation has been completed, and the determination of whether the printing operation has been completed is repeated until the printing operation is completed. If the printing operation has been completed, the process proceeds to step S84, and the evaporation amount V and the ink consumption amount In during printing and recovery operations as calculated in the above manner, and an initial value J of the ink amount in the circulating passage are referenced. Here, the initial value J of the ink amount in the circulating passage is a value determined in advance based on the shape of the circulating passage, the ink, and the like. In the present embodiment, the initial value J of the ink amount in the circulating passage is shown in Table 4.

TABLE 4

| Color | Bk | Cy | Ma | Ye |
|---|---|---|---|---|
| J[g] | 194 | 188 | 185 | 183 |

Next in step S85, a concentration N(x+1) after printing and recovery operations is calculated based on the evaporation amount V before and after printing and recovery operations, the ink consumption amount In during printing and recovery operations, the initial value J of the ink amount in the circulating passage, and the concentration N(x) before printing and recovery operations. A method for deriving a concentration N(x+1) will now be described. It should be noted that in the following description, an ink amount in the circulating passage before printing and recovery operations is expressed by J(x).

An amount of pigment included in ink present in the circulating passage at a stage before printing and recovery operations is expressed by N(x)×J(x), where N(x) is a concentration and J(x) is an ink amount. Furthermore, an ink amount is expressed by {J(x)−In−V} because after printing and recovery operations, ink is lost in the ink consumption amount In and in the evaporation amount V through the printing and recovery operations themselves, as compared to the ink before printing and recovery operations. Meanwhile, since a concentration at a stage after printing and recovery operations is expressed by N(x+1), an amount of pigment included in ink present in the circulating passage at a stage after printing and recovery operations is expressed by {N(x+1)×(J(x)−In−V)}.

Moreover, the ink ejected through printing and recovery operations also includes pigment. An amount of the pigment is expressed by {N(x)×In}, where N(x) is a concentration and In is an ink consumption amount. Here, since the pigment does not evaporate, the amount V of ink lost by evaporation does not include pigment. Accordingly, the sum of the amount of pigment present in the circulating passage after printing and recovery operations and the amount of pigment lost by ejection during printing and recovery operations is equal to the amount of pigment present in the circulating passage before printing and recovery operations. Therefore, the following [Equation 1] can be derived.

$$\{N(x+1)\times(J(x)-In-V)\}+\{N(x)\times In\}=N(x)\times J(x) \quad \text{[Equation 1]}$$

Based on [Equation 1], a concentration N(x+1) in the circulating passage after printing and recovery operations can be calculated by the following [Equation 2]:

$$N(x+1)=\{N(x)\times(J(x)-In)\}/(J(x)-In-V) \quad \text{[Equation 2]}$$

Here, since a value of J(x) is remarkably large compared to In and V, the term J(x) can be approximate to the initial value J of ink. Therefore, the following [Equation 3] can be derived.

$$N(x+1)=\{N(x)\times(J-In)\}/(J-In-V) \quad \text{[Equation 3]}$$

In the present embodiment, based on the above [Equation 3], the concentration N(x+1) after printing and recovery operations is calculated.

Then in step S86, the current concentration N(x) is updated to N(x+1), and the processing is completed.

It should be noted that the concentration N(x+1) has been calculated by using [Equation 3] in the present embodiment, but it is also possible to calculate the concentration N(x+1) by using [Equation 2] which does not include approximation of J(x). In this case, it is needed to separately calculate the ink amount J(x) in the circulating passage before printing and recovery operations. However, without approximation, it is possible to calculate the concentration N(x+1) more accurately.

In the present embodiment, the pigment concentration of the ink in the circulating passage is managed by updating the pigment concentration N(x) in this manner.

Figure 30:
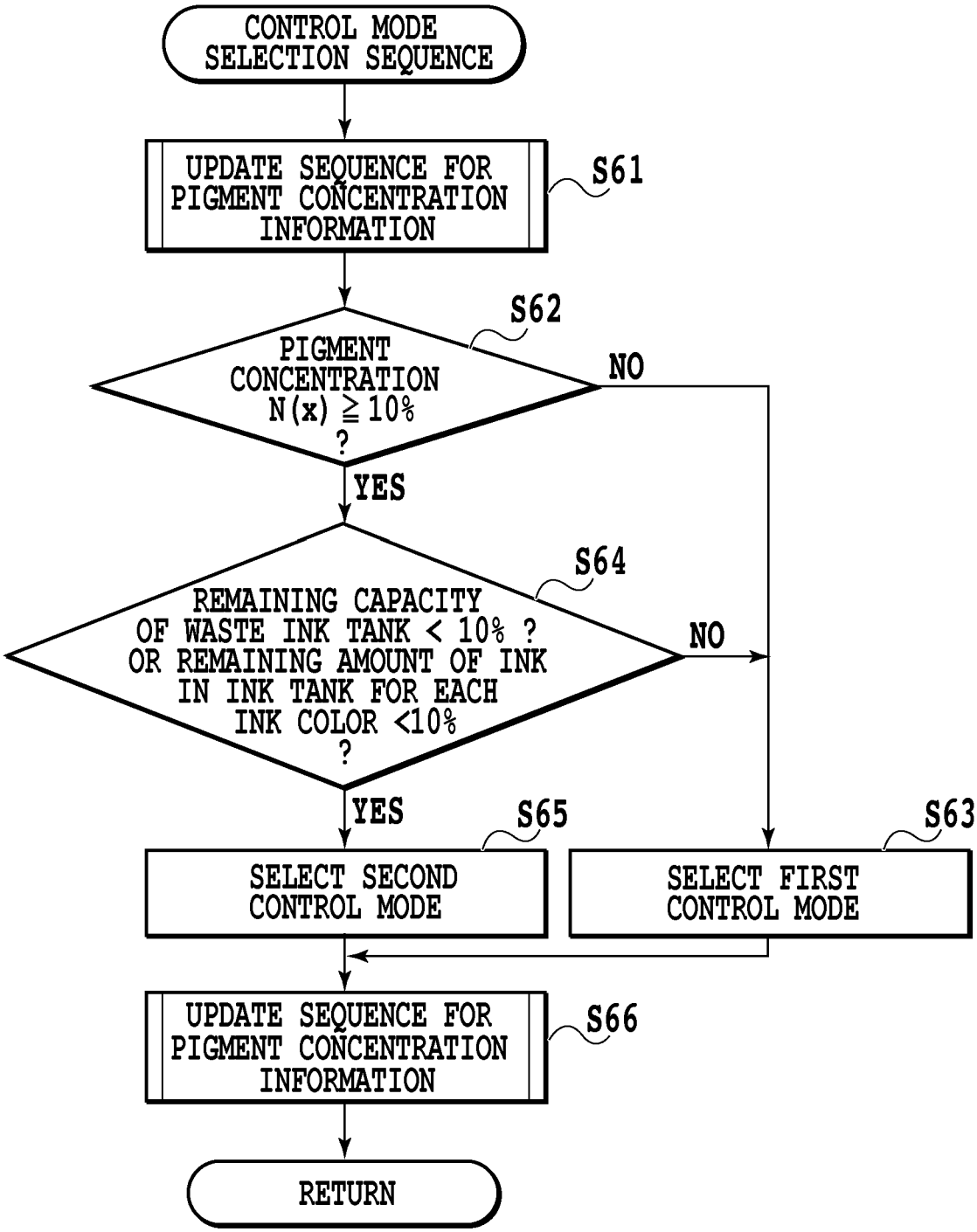
FIG. 30 is a flow chart for explaining a control mode selection sequence.

FIG. 30 is a flow chart for explaining control mode selection processing. First, the pigment concentration N(x) is updated by the update sequence for pigment concentration information shown in FIG. 29 (step S61), and then it is determined whether the pigment concentration N(x) exceeds a predetermined value (a pigment concentration of 10% in the present example) (step S62). In a case where the pigment concentration N(x) is lower than the predetermined value, the first control mode is selected (step S63). In a case where the pigment concentration N(x) is equal to or greater than the predetermined value, it is determined whether a remaining capacity of the waste ink tank containing waste ink is less than 10% or whether a remaining amount of ink in the ink tank for each ink color is less than 10% (step S64). If the result is a positive determination, the second control mode is selected (step S65). If the result is a negative determination, the first control mode is selected (step S63). After the first or second control mode is selected, the process proceeds to the update sequence for the pigment concentration information shown in FIG. 28 (step S66). In the second control mode, like the above-described embodiments, an image is printed by having a high target regulated temperature of the nozzle chips or by having a low ink maximum ejection frequency while suppressing a recovery amount as compared to the first control mode.

Other Embodiments

Selection between the first and second control modes may also be made depending on an image print mode (liquid ejection operation mode) such as a high-speed print mode, a simple print mode, and a high image quality mode or may be based on instructions by a user.

Moreover, the present invention can be applied widely as a liquid ejection apparatus and a liquid ejection method for ejecting various kinds of liquid. The present invention is also applicable to liquid ejection apparatuses that perform various kinds of processing (printing, treatment, coating, irradiation, etc.) on various kinds of media (sheets) by using ejection heads capable of ejecting liquid.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-234271 filed Dec. 1, 2016, which is hereby incorporated by reference wherein in its entirety.

What is claimed is:

1. A printing apparatus comprising:

an ejection head including nozzles from which ink is ejected;

a print control unit configured to perform a printing operation by ejecting liquid from the ejection head; and a reserving unit configured to reserve liquid supplied to the ejection head, a circulating passage for circulating liquid between the reserving unit and the ejection head;

a recovery control unit configured to perform a recovery operation to recover an ejection state in the ejection head before the printing operation is performed by the print control unit;

an acquisition unit configured to acquire information relating to a degree of concentration of ink in the circulating passage; and a setting unit configured to set a control mode among a plurality of control modes based on the acquired information so as to set (i) a first control mode where a first recovery operation is performed and the printing operation is performed under a first printing condition, in a case where the degree represented by the information is lower than a predetermined degree; or (ii) a second control mode where a second recovery operation for recovery at a lower level than a level at which the first recovery operation is performed, or the recovery operation is not performed, and the printing operation is performed under a second printing condition, in a case where the degree represented by the information is not lower than the predetermined degree, wherein the second printing condition corresponds to at least one of (a) a higher target temperature, at which the ejection head is maintained during the printing operation, than a target temperature for the ejection head during the printing operation under the first printing condition and (b) a lower ejection frequency of the nozzles than an ejection frequency of the nozzles in the first printing condition.

2. The printing apparatus according to claim 1, wherein under the second recovery operation, a time required for the recovery operation is shorter compared to the first recovery operation.

3. The printing apparatus according to claim 1, wherein under the second recovery operation, an amount of liquid consumed by the recovery operation is smaller compared to the first recovery operation.

4. The printing apparatus according to claim 1, wherein in the second control mode, the recovery operation is not performed.

5. The printing apparatus according to claim 1, wherein the recovery control unit performs the recovery operation including at least one of an operation to discharge ink in the ejection head outside, an operation to suck the ink from an ejection port provided on the ejection head, and an operation to circulate the ink in the ejection head.

6. The printing apparatus according to claim 1, further comprising a temperature control unit capable of controlling a temperature of the ejection head, wherein the temperature control unit controls the temperature of the ejection head so as to set the first printing condition and the second printing condition.

7. The printing apparatus according to claim 1, wherein the acquisition unit acquires the information based on at least one of environmental temperature and environmental humidity.

8. The printing apparatus according to claim 1, wherein the acquisition unit acquires the information based on an amount of liquid in the circulating passage.

9. The printing apparatus according to claim 1, wherein the setting unit sets the first control mode in a case where a remaining amount of liquid in a reserving portion for reserving liquid to be supplied to the ejection head is equal to or greater than a predetermined amount and sets the second control mode in a case where the remaining amount of liquid is less than the predetermined amount.

10. The printing apparatus according to claim 1, wherein the setting unit sets the first control mode in a case where a remaining capacity of a containing unit for containing liquid to be discharged through the recovery operation by the recovery control unit is equal to or greater than a predetermined amount and sets the second control mode in a case where the remaining capacity is less than the predetermined amount.

11. The printing apparatus according to claim 1, wherein the setting unit sets the first control mode in a case where printing is performed focusing on an image quality during the printing operation performed by the print control unit and sets the second control mode in a case where printing is performed focusing on a speed during the printing operation performed by the print control unit.

12. The printing apparatus according to claim 1, wherein the liquid is ink.

13. A printing method for printing by ejecting liquid from an ejection head including nozzles, the printing method comprising:

a printing step of performing a printing operation by ejecting liquid from the ejection head;

a circulating step of circulating liquid between a reserving unit for reserving liquid and the ejection head through a circulating passage;

a recovery step of performing a recovery operation to recover an ejection state in the ejection head before the printing operation;

an acquisition step of acquiring information relating to a degree of concentration of ink in the circulating passage; and a setting step of setting a control mode among a plurality of control modes based on the acquired information so as to set (i) a first control mode where a first recovery operation is performed and the printing operation is performed under a first printing condition, in a case where the degree represented by the information is lower than a predetermined degree, or (ii) a second control mode where a second recovery operation for recovery at a lower level than a level at which the first recovery operation is performed, or the recovery operation is not performed, and the printing operation is performed under a second printing condition, in a case where the degree represented by the information is not lower than the predetermined degree, wherein the second printing condition corresponds to at least one of (a) a higher target temperature, at which the ejection head is maintained during the printing operation, than a target temperature for the ejection head during the printing operation under the first printing condition and (b) a lower ejection frequency of the nozzles than an ejection frequency of the nozzles in the first printing condition.

* * * * *